US008588661B2

(12) United States Patent
Ota

(10) Patent No.: US 8,588,661 B2
(45) Date of Patent: Nov. 19, 2013

(54) DEVELOPER STORAGE CONTAINER, DEVELOPING DEVICE AND IMAGE FORMING APPARATUS

(75) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 296 days.

(21) Appl. No.: 12/926,220

(22) Filed: Nov. 3, 2010

(65) Prior Publication Data

US 2011/0103846 A1 May 5, 2011

(30) Foreign Application Priority Data

Nov. 4, 2009 (JP) ..... 2009-252754

(51) Int. Cl.
*G03G 15/08* (2006.01)

(52) U.S. Cl.
USPC ..... 399/263; 399/120

(58) Field of Classification Search
USPC ..... 399/262, 263, 253, 258, 120
See application file for complete search history.

(56) References Cited

U.S. PATENT DOCUMENTS

| | | | | |
|---|---|---|---|---|
| 6,026,263 | A | 2/2000 | Nakahata et al. | |
| 6,456,810 | B1 * | 9/2002 | Deguchi et al. | 399/254 |
| 2007/0264051 | A1 * | 11/2007 | Tanaka | 399/254 |
| 2008/0205939 | A1 | 8/2008 | Mase et al. | |
| 2008/0279594 | A1 * | 11/2008 | Sakoh et al. | 399/262 |
| 2008/0279595 | A1 | 11/2008 | Uezono | |

FOREIGN PATENT DOCUMENTS

| | | | |
|---|---|---|---|
| CN | 101303555 | A | 11/2008 |
| JP | 2002-229316 | | 8/2002 |
| JP | 2007-264165 | A | 10/2007 |
| JP | 2008-276139 | | 11/2008 |

* cited by examiner

*Primary Examiner* — Walter L Lindsay, Jr.
*Assistant Examiner* — Roy Y Yi
(74) *Attorney, Agent, or Firm* — Rabin & Berdo, P.C.

(57) ABSTRACT

A developer storage container includes a developer storage portion that stores a developer and has an opening for supplying the developer. An agitating-and-supplying member is rotatably provided in the developer storage portion. The agitating-and-supplying member has a shaft portion and an agitating portion. The agitating portion has a fixed end and a distal end opposite to each other. The fixed end of the agitating portion is fixed to the shaft portion. The agitating portion has an area corresponding to the opening. In the area, a distance between a center axis of the shaft portion and the distal end of the agitating portion is longer than a distance between the center axis of the shaft portion and an outer wall of the developer storage portion.

17 Claims, 17 Drawing Sheets

DEVELOPER STORAGE CONTAINER, DEVELOPING DEVICE AND IMAGE FORMING APPARATUS

BACKGROUND OF THE INVENTION

The present invention relates to a developer storage container for storing a developer, and relates to a developing device and an image forming apparatus using the developer storage container.

In a general electrophotographic printer, a surface of a photosensitive drum is uniformly charged by a charging device, and then exposed by an exposing device to form a latent image. The latent image is developed by a developing device to form a toner image. The toner image is transferred to a printing medium by a transfer unit, and is fixed to the printing medium by a fixing device.

As the developing device repeatedly performs the developing process, the amount of a toner (i.e., a developer) in the developing device decreases. Therefore, the developing device has a toner cartridge detachably mounted to a main body of the developing device. When the toner stored in the developing device is used up, the toner cartridge is replaced with new one, so as to replenish the toner to the developing device.

The toner cartridge has a toner supplying opening (i.e., a developer supplying opening) through which the toner is supplied to a toner hopper in the main body of the developing device. The toner supplying opening is formed to be relatively small (particularly, with respective to a length of the toner cartridge), in order to prevent decrease in rigidity of the toner cartridge, to prevent leakage of the toner, and to prevent scattering of the toner during a replacement operation of the toner cartridge.

The main body of the developing device has a toner receiving opening through which the toner is supplied to the toner hopper. The toner receiving opening is provided in a partial area in the longitudinal direction of the developing device, corresponding to the toner supplying opening of the toner cartridge. The developing device has an agitating-and-conveying unit provided in the toner hopper, which agitates and conveys the toner throughout a length of the developing device (see, Japanese Laid-open Patent Publication No. 2007-264165).

Recently, there is a need for a technique capable of effectively preventing a stagnation of a developer supplied via a developer supplying opening.

SUMMARY OF THE INVENTION

The present invention is intended to provide a developer storage container, a developing device and an image forming apparatus capable of effectively preventing a stagnation of a developer supplied via an opening of the developer storage container.

The present invention provides a developer storage container including a developer storage portion that stores a developer and has an opening for supplying the developer. An agitating-and-supplying member is rotatably provided in the developer storage portion. The agitating-and-supplying member has a shaft portion and an agitating portion. The agitating portion has a fixed end and a distal end opposite to each other. The fixed end of the agitating portion is fixed to the shaft portion. The agitating portion has an area corresponding to the opening. In the area, a distance between a center axis of the shaft portion and the distal end of the agitating portion is longer than a distance between the center axis of the shaft portion and an outer wall of the developer storage portion.

With such a configuration, it becomes possible to prevent a stagnation of the developer supplied via the opening of the developer storage container.

The present invention also provides a developing device including the above described developer storage container.

The present invention also provides an image forming apparatus including the above described developer storage container.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

Figure 1:
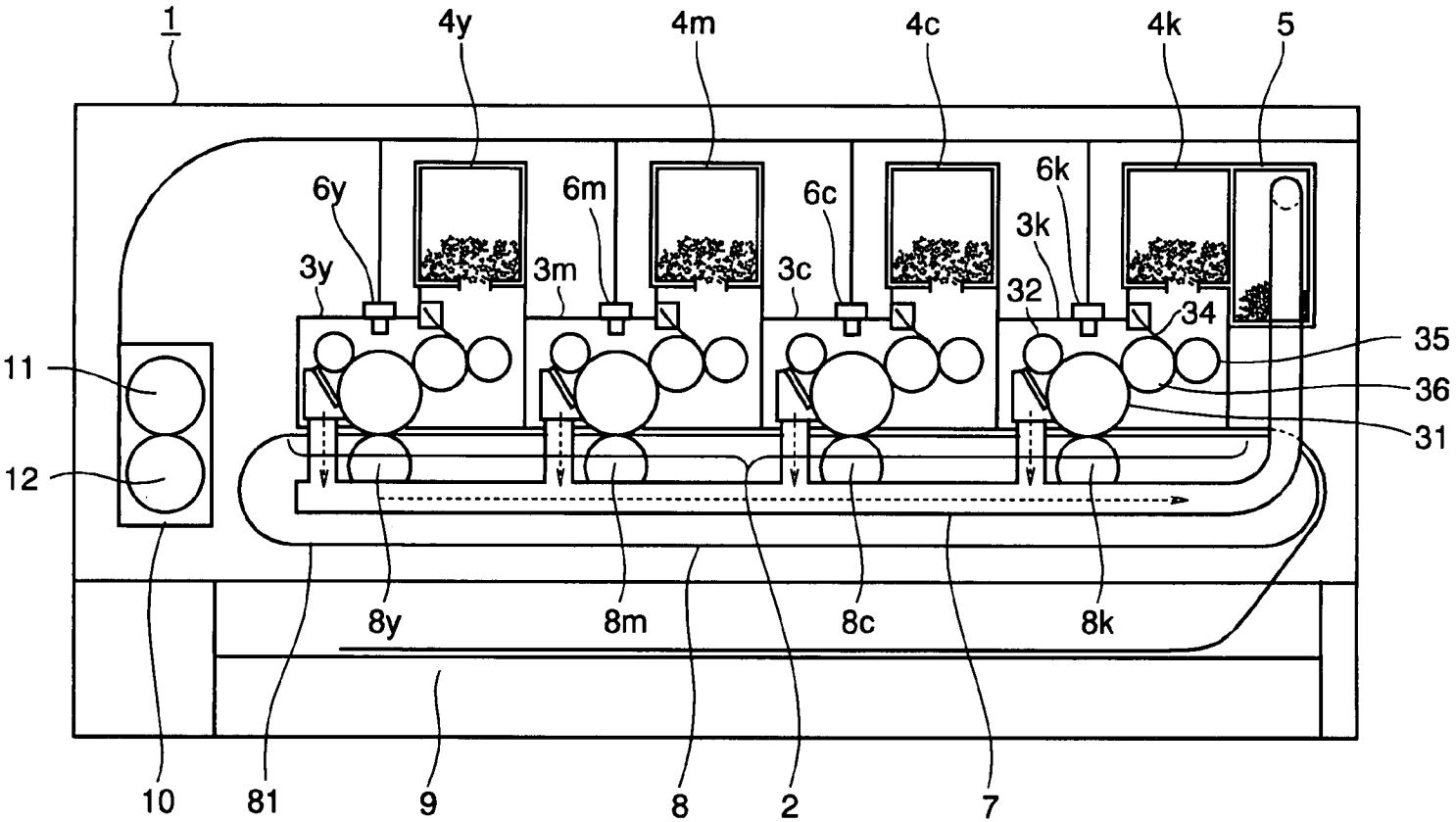
FIG. 1 is a schematic view showing a configuration of an image forming apparatus according to the first embodiment.

FIG. 1 is a schematic view showing a configuration of an image forming apparatus 1 according to the first embodiment of the present invention. As shown in FIG. 1, the image forming apparatus 1 includes a developing device 2, exposing units 6*k*, 6*c*, 6*m* and 6*y*, a transferring unit 8, a feeding cassette 9 and a fixing unit 10.

The developing device 2 includes developing units (also referred to as process units) 3*k*, 3*c*, 3*m* and 3*y* for forming toner images of black, cyan, magenta and yellow, and toner cartridges 4*k*, 4*c*, 4*m* and 4*y* respectively storing toners (developers) of black, cyan, magenta and yellow. The developing device 2 further includes a waste toner storage container 5 and a waste toner conveying unit 7.

The developing device 2 has an integral structure, and is detachably mounted to a main body of the image forming apparatus 1.

The developing units 3*k*, 3*c*, 3*m* and 3*y* are arranged along a medium feeding path in this order from an upstream side (i.e., a supply side) to a downstream side (i.e., an ejection side).

The toner cartridges 4*k*, 4*c*, 4*m* and 4*y* (as developer storage containers) are detachably mounted to the respective developing units 3*k*, 3*c*, 3*m* and 3*y*. The toner cartridges 4*k*, 4*c*, 4*m* and 4*y* stores toners of the respective colors, and supply the toners to the developing units 3*k*, 3*c*, 3*m* and 3*y*.

The waste toner storage container 5 collectively stores the waste toner ejected from the developing units 3*k*, 3*c*, 3*m* and 3*y*.

The exposing units 6*k*, 6*c*, 6*m* and 6*y* are provided so as to face photosensitive drums 31 (described later) of the developing units 3*k*, 3*c*, 3*m* and 3*y*. The exposing units 6*k*, 6*c*, 6*m* and 6*y* respectively expose the surfaces of the photosensitive drums 31 to form latent images. The exposing units 6*k*, 6*c*, 6*m* and 6*y* are constituted by LED heads in this embodiment, but the exposing units 6*k*, 6*c*, 6*m* and 6*y* are not-limited to LED heads.

The transfer unit 8 includes transfer rollers 8*k*, 8*c*, 8*m* and 8*y* provided so as to face the photosensitive drums 31 of the developing units 3*k*, 3*c*, 3*m* and 3*y*, and a transfer belt 81 passing between the respective photosensitive drums 31 and the transfer rollers 8*k*, 8*c*, 8*m* and 8*y*. The transfer unit 8 transfers toner images from the photosensitive drums 31 to a printing medium.

The feeding cassette 9 stores and feeds the printing media such as papers to the developing units 3*k*, 3*c*, 3*m* and 3*y* and the transfer unit 8.

The fixing unit 10 includes a fixing roller 11 and a pressure roller 12 which fix the toner image to the printing medium by application of heat and pressure.

Hereinafter, the developing units 3*k*, 3*c*, 3*m* and 3*y* will be collectively referred to as the developing units 3. The toner cartridges 4*k*, .4*c*, 4*m* and 4*y* will be collectively referred to as the toner cartridges 4. The exposing units 6*k*, 6*c*, 6*m* and 6*y* will be collectively referred to as the exposing units 6.

Figure 2:
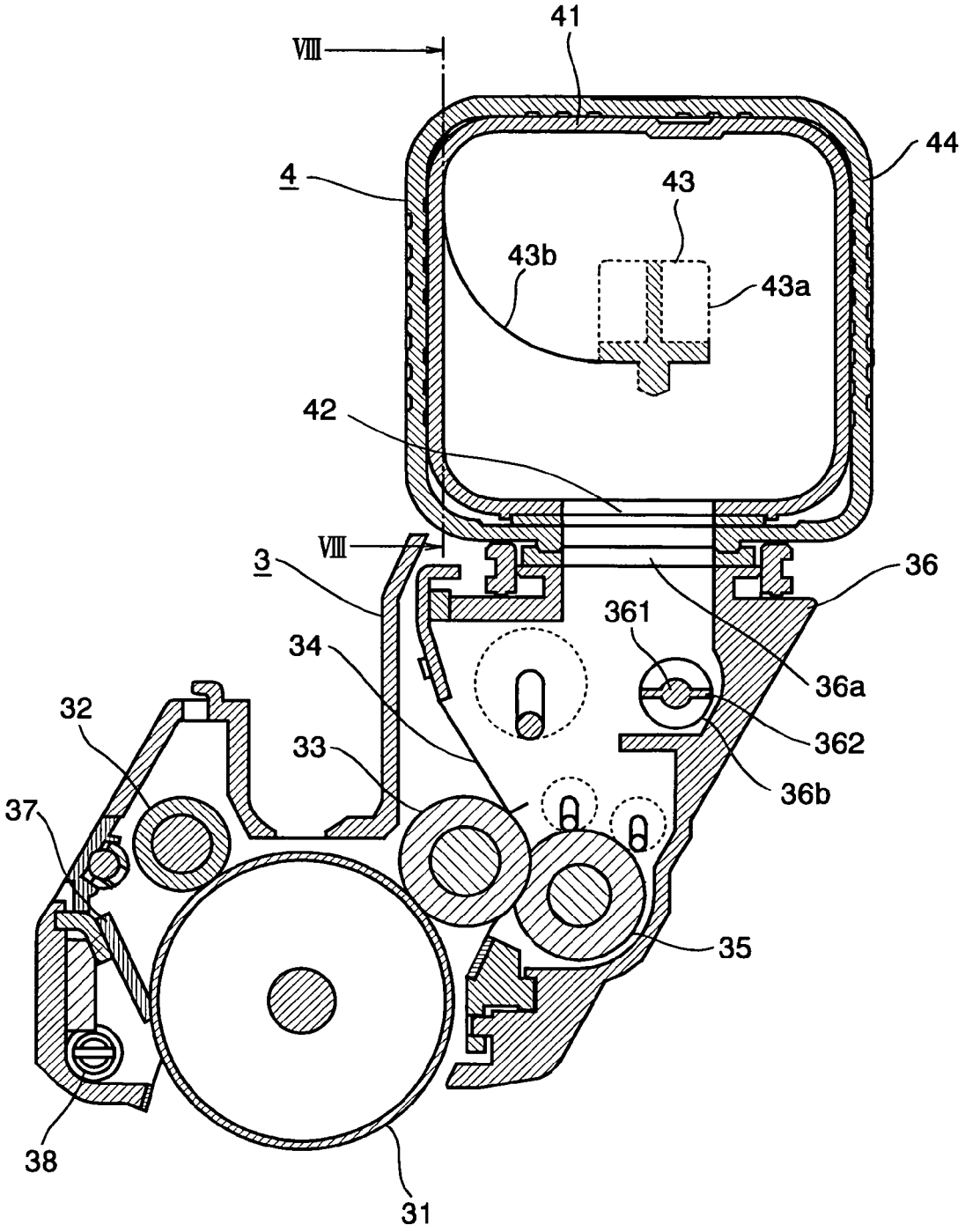
FIG. 2 is a cross sectional view showing a developing unit and a toner cartridge according to the first embodiment.

FIG. 2 is a cross sectional view showing the developing unit 3 and the toner cartridge 4 according to the first embodiment.

As shown in FIG. 2, the developing unit 3 (i.e., the process unit) includes a photosensitive drum 31 as an image bearing body, a charging roller 32 as a charging device, a developing roller 33 as a developer bearing body, a developing blade 34 as a developer regulating member, a supplying roller 35 as a developer supplying member, a toner hopper 36 as a developer reservoir, a cleaning blade 37 as a cleaning member and a removed-toner conveying unit 38.

The photosensitive drum 31 is an image bearing body on which a latent image is formed. The charging roller 32 uniformly charges the surface of the photosensitive drum 31. The developing roller 33 supplies the toner to the photosensitive drum 31 to develop the latent image on the photosensitive drum 31. The supplying roller 35 supplies the toner to the developing roller 33. The developing blade 34 regulates a thickness of a toner layer on the surface of the developing roller 33. The toner hopper 36 stores the toner supplied by the toner cartridge 4.

The toner hopper 36 has a toner receiving opening 36*a* (as a developer receiving opening) and a feeding spiral 36*b* (as a developer distributing member).

The toner receiving opening 36*a* is formed on a top of the toner hopper 36. The toner receiving opening 36*a* is located at a position corresponding to a toner supplying opening 42 (described later) of the toner cartridge 4. In this embodiment, the toner receiving opening 36*a* is formed on a partial area of the toner hopper 36 in the longitudinal direction of the toner hopper 36 (i.e., parallel to an axial direction of the photosensitive drum 31). Further, in the longitudinal direction of the toner hopper 36, a length of the toner receiving opening 36*a* is shorter than the length of the toner hopper 36.

The feeding spiral 36*b* has a shaft portion 361 whose center axis extends in the longitudinal direction of the toner hopper 36, and a spiral blade 362 protruding from the shaft portion 361 in a direction crossing a longitudinal direction of the shaft portion 361. By the rotation of the feeding spiral 36*b*, the toner supplied into the toner hopper 36 (via the toner receiving opening 36*a*) is conveyed in the longitudinal direction of the toner hopper 36 along a surface of the spiral blade 362 of the feeding spiral 36*b*. The feeding spiral 36*b* (below the toner receiving portion 36*a*) is preferably disposed on a position shifted to a front side (i.e., a downstream side) with respect to a center of the toner receiving portion 36*a* in a rotating direction of an agitating-and-supplying member 43 (described later) of the toner cartridge 4.

The cleaning blade 37 is configured to remove a residual toner that is not transferred to the printing medium but remains on the surface of the photosensitive drum 31. The removed-toner conveying unit 38 conveys the toner removed by the cleaning blade 37 toward the waste toner conveying unit 7 shown in FIG. 1.

Figure 3:
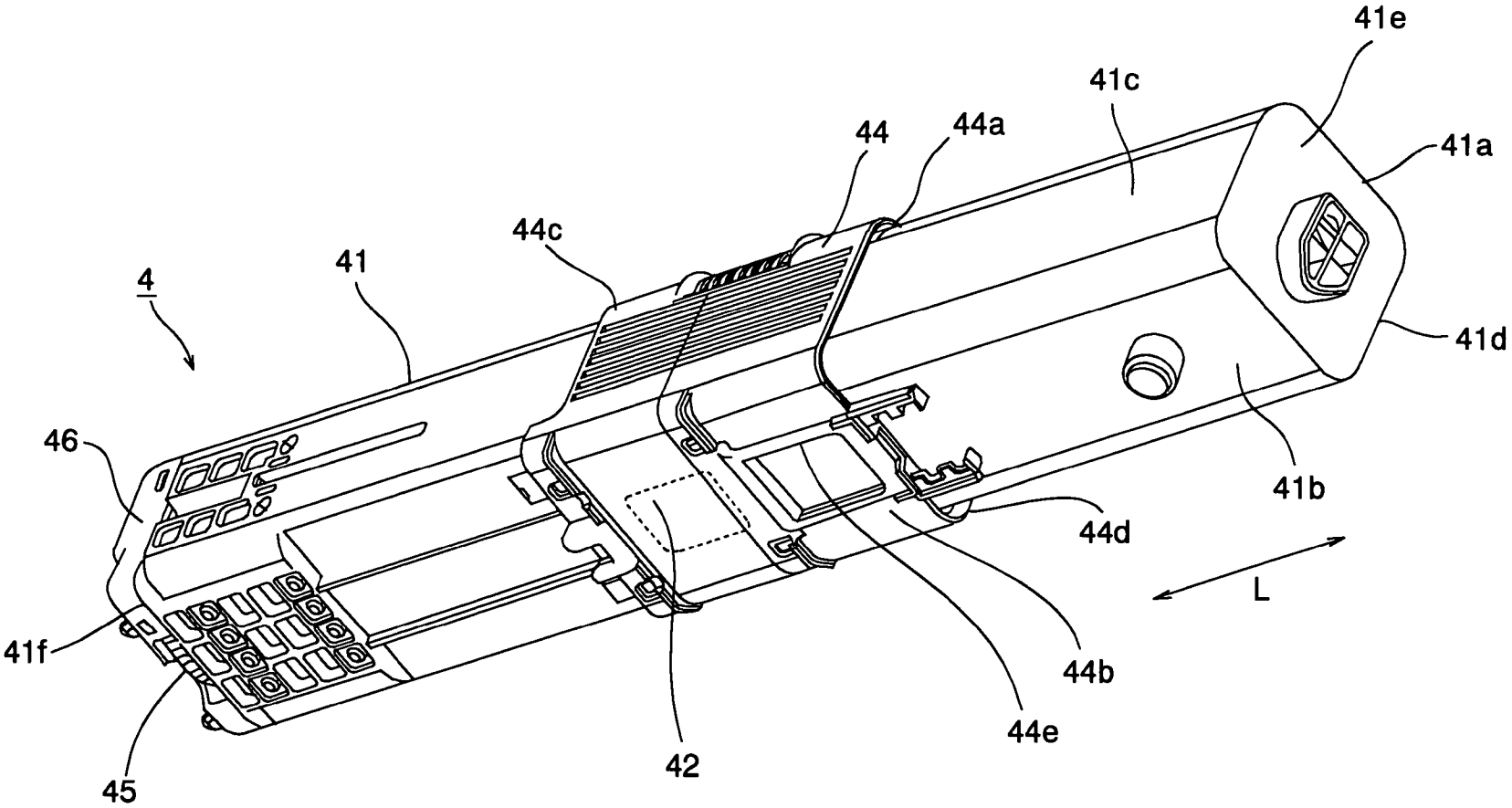
FIG. 3 is a bottom perspective view showing the toner cartridge according to the first embodiment.
Figure 4:
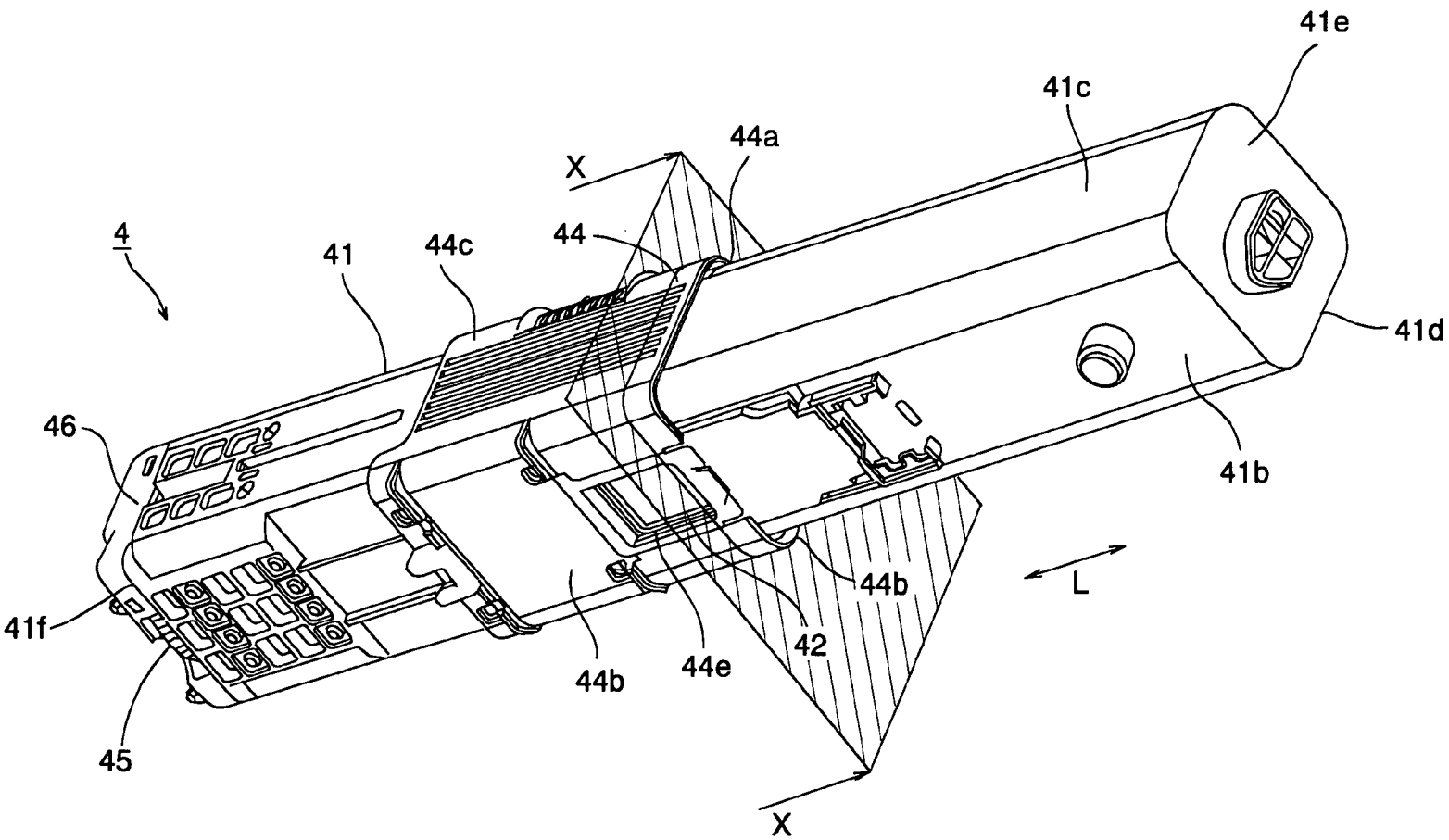
FIG. 4 is a bottom perspective view showing the toner cartridge according to the first embodiment.

FIGS. 3 and 4 are bottom perspective views showing the toner cartridge 4.

As shown in FIGS. 3 and 4, the toner cartridge 4 includes an outer frame 41 (as a developer storage portion) with a toner supplying opening 42 (as an opening), an agitating-and-supplying member 43, and a toner supplying opening shutter 44 (as a shutter).

The outer frame 41 has a box shape as shown in FIGS. 3 and 4, and stores the toner therein.

The toner supplying opening 42 is formed on the bottom of the outer frame 41. In this embodiment, the toner supplying opening 42 is formed on a partial area of the outer frame 41 in a longitudinal direction of the outer frame 41. Further, in the longitudinal direction of the outer frame 41 (indicated by an arrow L in FIGS. 3 and 4), a length of the toner supplying opening 42 is shorter than a length of the outer frame 41. In this embodiment, the toner supplying opening 42 is provided so as to encompass a center position of the outer frame 41 in the longitudinal direction.

The agitating-and-supplying member 43 (FIG. 2) is provided in the outer frame 41 so as to be rotatable about a center axis (i.e., a center line) parallel to the longitudinal direction of the outer frame 41.

The toner supplying opening shutter 44 is movable in the longitudinal direction (indicated by the arrow L) of the outer frame 41. The toner supplying opening shutter 44 is movable between a position shown in FIG. 3 where the toner supplying opening shutter 44 closes the toner supplying opening 42, and a position shown in FIG. 4 where the toner supplying opening shutter 44 opens the toner supplying opening 42.

The toner cartridge 4 includes the outer frame 41 and the toner supplying opening shutter 44 as described above, and further includes an agitating-and-supplying member driving gear 45 and a side cover 46.

The outer frame 41 is in the form of a rectangular column having a top wall 41*a*, a bottom wall 41*b*, a first side wall 41*c*, a second side wall 41*d*, a third side wall 41*e* and a fourth side wall 41*f*. The walls 41*a* through 41*f* surround a space for storing the toner therein.

In this embodiment, the outer frame 41 is in the form of the rectangular column. However, the outer frame 41 can be in the form of, for example, a circular cylinder or a polygonal column such as a triangular column.

Shaft-holes (not shown) are formed on inner sides of the third wall 41*e* and the fourth wall 41*f* which are disposed on both ends of the outer frame 41 in the longitudinal direction. End portions (i.e., pins 43*c* and 43*d* shown in FIG. 5) of a shaft portion of the agitating-and-supplying member 43 engage and are supported by the shaft-holes.

The toner supplying opening 42 is formed on the bottom wall 41*b* of the outer frame 41. The toner supplying opening 42 is located on a partial area in the longitudinal direction of the outer frame 41. The toner supplying opening 42 has a rectangular shape. Two longer edges of the toner supplying opening 42 are parallel to longer edges of the bottom wall 41*b* (i.e., parallel to the longitudinal direction of the outer frame 41).

The toner supplying opening shutter 44 includes a top wall 44*a*, a bottom wall 44*b*, a first side wall 44*c* and a second side wall 44*d*. The top wall 44*a*, the bottom wall 44*b*, the first side wall 44*c* and the second side wall 44*d* surround the outer frame 41. That is, an inner surface of the top wall 44*a* faces an outer surface of the top wall 41*a*. An inner surface of the bottom wall 44*b* faces an outer surface of the bottom wall 41*b*. An inner surface of the first side wall 44*c* faces an outer surface of the first side wall 41*c*. An inner surface of the second side wall 44*d* faces an outer surface of the second side wall 41*d*. The toner supplying opening shutter 44 has two opened ends in the longitudinal direction of the outer frame 41, and the toner supplying opening shutter 44 is movable in the longitudinal direction of the outer frame 41 (i.e., in the direction indicated by the arrow L).

A toner ejection opening 44*e* (as an ejection opening) is formed on the bottom wall 44*b* of the toner supplying opening shutter 44. The toner ejection opening 44*e* has substantially the same shape as the toner supplying opening 42. When the toner supplying opening shutter 44 is moved in the longitudinal direction of the outer frame 41 as shown in FIG. 4, the toner ejection opening 44*e* faces the toner supplying opening 42, so that the toner stored in the outer frame 41 is ejected outside (i.e., to the toner hopper 36). In contrast, when the toner supplying opening shutter 44 is moved in the longitudinal direction of the outer frame 41 as shown in FIG. 3, the toner ejection opening 44*e* does not face the toner supplying opening 42 (instead, the toner ejection opening 44*e* faces the bottom wall 44*b*), so that an inner space of the outer frame 41 is closed.

The agitating-and-supplying member driving gear 45 is provided on the fourth side wall 41*f* disposed on the end of the outer frame 41 in the longitudinal direction. The agitating-and-supplying member driving gear 45 transmits a rotation of a driving unit (not shown) provided on the developing unit 3 to the agitating-and-supplying member 43 in the outer frame 41.

The side cover 46 is formed on the fourth side wall 41*f* so as to cover the agitating-and-supplying member driving gear 45.

In order to prevent leakage of the toner, seal members such as sponges are provided on a gap between the toner supplying opening 42 and the bottom wall 44*b* of the toner supplying opening shutter 44, and a gap between the pins 43*c* and 43*d* (FIG. 5) of the agitating-and-supplying member 43 and the shaft-holes (not shown) of the third and fourth side walls 41*e* and 41*f*.

Figure 5:
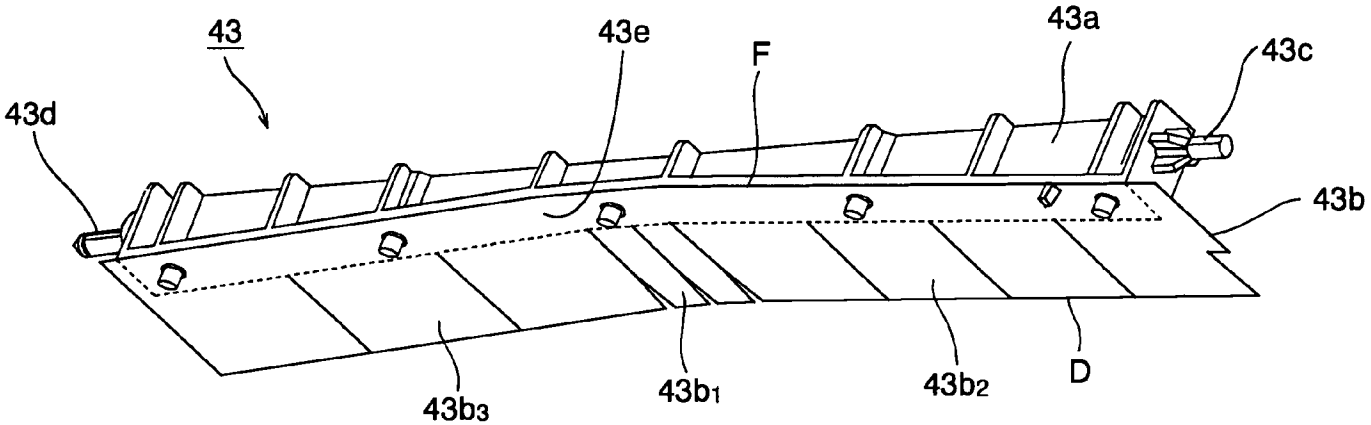
FIG. 5 is a perspective view showing an agitating-and-supplying member provided in the toner cartridge according to the first embodiment.

FIG. 5 is a perspective view showing the agitating-and-supplying member 43 provided in the toner cartridge 4. As shown in FIG. 5, the agitating-and-supplying member 43 has a shaft portion 43*a* and an agitating portion 43*b*.

The shaft portion 43*a* extends linearly, and has first and second pins (i.e., supporting pins) 43*c* and 43*d* provided on both ends in the longitudinal direction. The pins 43*c* and 43*d* are inserted into the shaft-holes (not shown) formed on the inner sides of the third and fourth side walls 41*e* and 41*f* of the outer frame 41, so that the shaft portion 43*a* is supported so as to be rotatable about a center axis of the shaft portion 43*a*.

Figure 6:
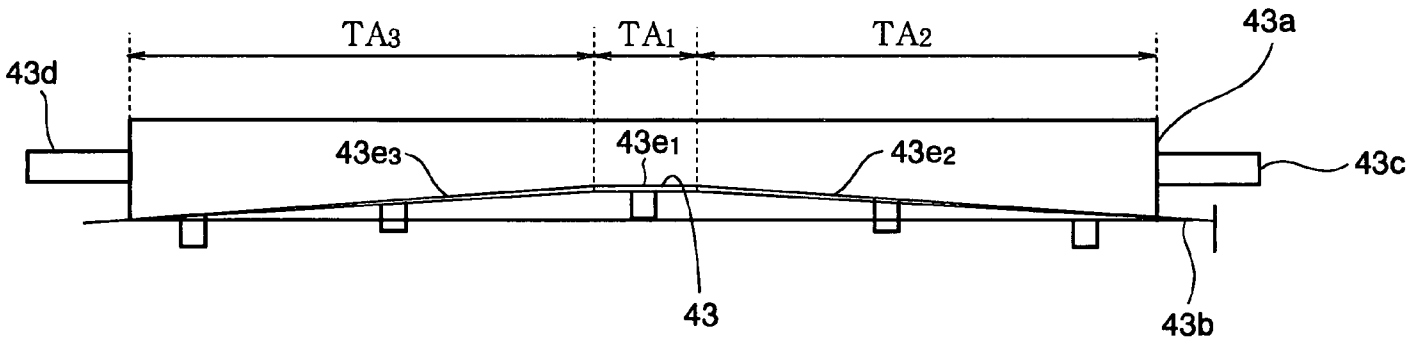
FIG. 6 is a bottom view showing the agitating-and-supplying member provided in the toner cartridge according to the first embodiment.

The shaft portion 43*a* has a mounting surface 43*e* extending along the center axis of the shaft portion 43*a*. FIG. 6 is a bottom view of the agitating-and-supplying member 43. As shown in FIG. 6, the mounting surface 43*e* has a first area $TA_1$ at a center in the longitudinal direction, and second and third areas $TA_2$ and $TA_3$ on both sides of the first area $TA_1$. The second area $TA_2$ is disposed on the first pin 43*c*, and the third area $TA_3$ is disposed on the second pin 43*d*.

The mounting surface $43e_1$ of the first area $TA_1$ is a surface whose normal line is perpendicular to the center axis of the shaft portion 43*a*. The mounting surface $43e_2$ of the second area $TA_2$ is inclined so that a distance from the center axis of the shaft portion 43*a* increases toward the first pin 43*c* side. The mounting surface $43e_3$ of the third area $TA_3$ is inclined so that a distance from the center axis of the shaft portion 43*a* increases toward the second pin 43*d* side.

An angle between the mounting surface $43e_1$ of the first area $TA_1$ and the mounting surface $43e_2$ of the second area $TA_2$, and an angle between the mounting surface $43e_1$ of the first area $TA_1$ and the mounting surface $43e_3$ of the third area $TA_3$ can be arbitrarily determined so as to cause the toner to move from the agitating portion $43b_2$ fixed to the mounting surface $43e_2$ and the agitating portion $43b_3$ fixed to the mounting surface $43e_3$ toward the agitating portion $43b_1$ fixed to the mounting surface $43e_1$ as described later. A length of the mounting surface $43e_1$ of the first area $TA_1$ is shorter than the toner supplying opening 42 of the outer frame 41 in the longitudinal direction of the outer frame 41.

The agitating portion 43*b* is fixed to the mounting surface 43*e* via a fixing means such as an adhesive agent.

Figure 7:
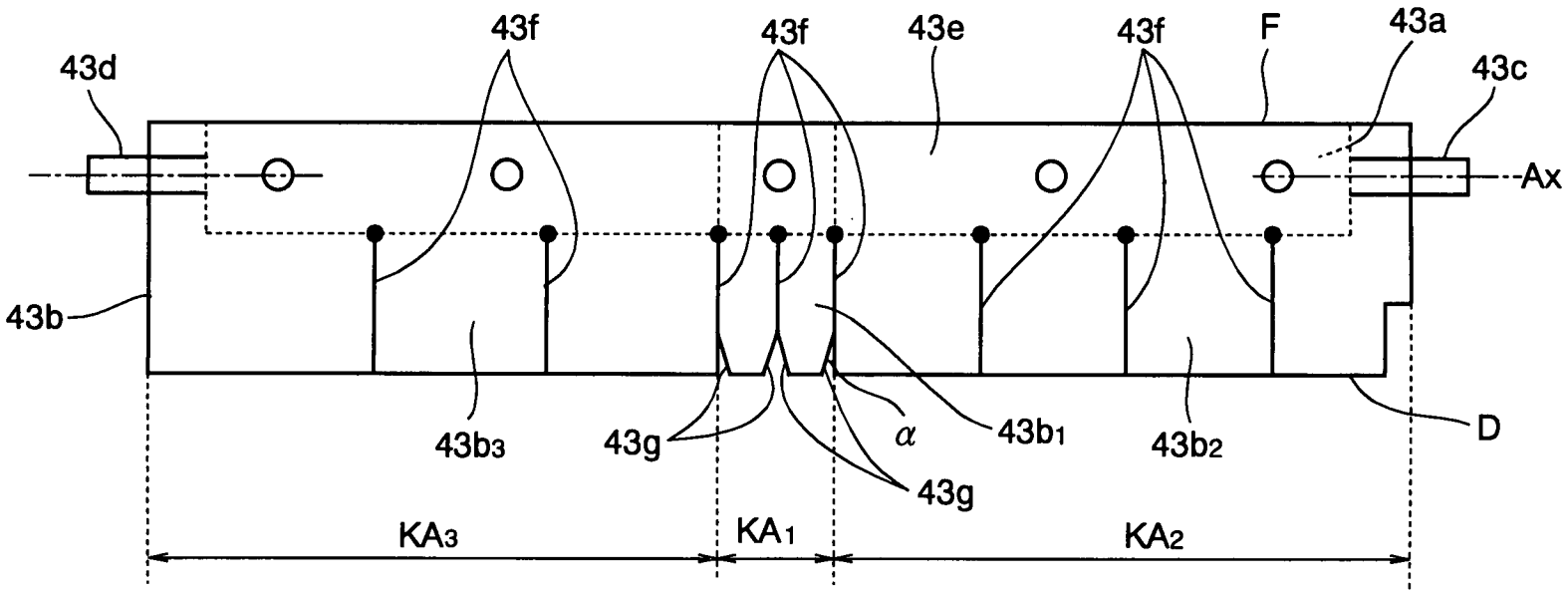
FIG. 7 is a front view showing the agitating-and-supplying member according to the first embodiment.

FIG. 7 is a front view of the agitating portion 43*b*. The agitating portion 43*b* has a substantially rectangular shape elongated along the shaft portion 43*a*. One of longer edges of the agitating portion 43*b* is fixed to the mounting surface 43*e* of the shaft portion 43*a*. Hereinafter, the longer edge of the agitating portion 43*b* fixed to the mounting surface 43*e* will be referred to as a fixed longer edge F (also referred to as a fixed end).

The agitating portion 43*b* is formed of a resilient member such as a film member. For example, the agitating portion 43*b* is formed by bending a resilient member (for example, a film) having a flat shape. In this case, the resilient member is going to recover its original flat shape, so that a resilient force is generated. The agitating portion 43*b* can be formed of a material that generates a resilient force as described later. In this embodiment, the agitating portion 43*b* is formed of polyethylene terephthalate (PET).

The thickness of the agitating portion 43*b* is preferably in a range from 0.05 mm to 0.15 mm for generating a necessary resilient force. The most preferable thickness of the agitating portion 43*b* is preferably 0.10 mm.

In the longitudinal direction of the outer frame 41, the length of the agitating portion 43*b* (fixed to the mounting surface 43*e*) is shorter than a distance between the inner surfaces of the third side wall 41*e* and the fourth side wall 41*f* of the outer frame 41.

When the agitating portion 43*b* is held in a flat shape as shown in FIG. 7, a distance between the center axis (indicated by a mark "Ax") of the shaft portion 43*a* and a longer edge of the agitating portion 43*b* farthest from the shaft portion 43*a* is longer than a maximum distance between the center axis of the shaft portion 43*a* and the inner surface of the outer frame 41.

Therefore, in a state where the agitating-and-supplying member 43 is mounted in the outer frame 41, the agitating portion 43*b* contacts the inner surface of the outer frame 41 in a deflected manner. Hereinafter, the longer edge of the agitating portion 43*b* farthest from the shaft portion 43*a* will be referred to as a distal longer edge D (also referred to as a distal end).

The agitating portion 43*b* has a plurality of slits 43*f* extending from the distal longer edge D toward the fixed longer edge L of the agitating portion 43*b*.

The agitating portion 43*b* has a first area $KA_1$, a second area $KA_2$ and a third area $KA_3$ corresponding to the first area $TA_1$, the second area $TA_2$ and the third area $TA_3$ of the mounting surface 43*e* of the shaft portion 43*a*. These areas $KA_1$, $KA_2$ and $KA_3$ are separated by slits 43*f*. It is also possible to form additional slit(s) 43*f* within the areas $KA_1$, $KA_2$ and $KA_3$, in addition to the slits 43*f* separating the areas $KA_1$, $KA_2$ and $KA_3$. The numbers of the slits 43*f* within the areas $KA_1$, $KA_2$ and $KA_3$ can be arbitrarily determined.

Figure 8:
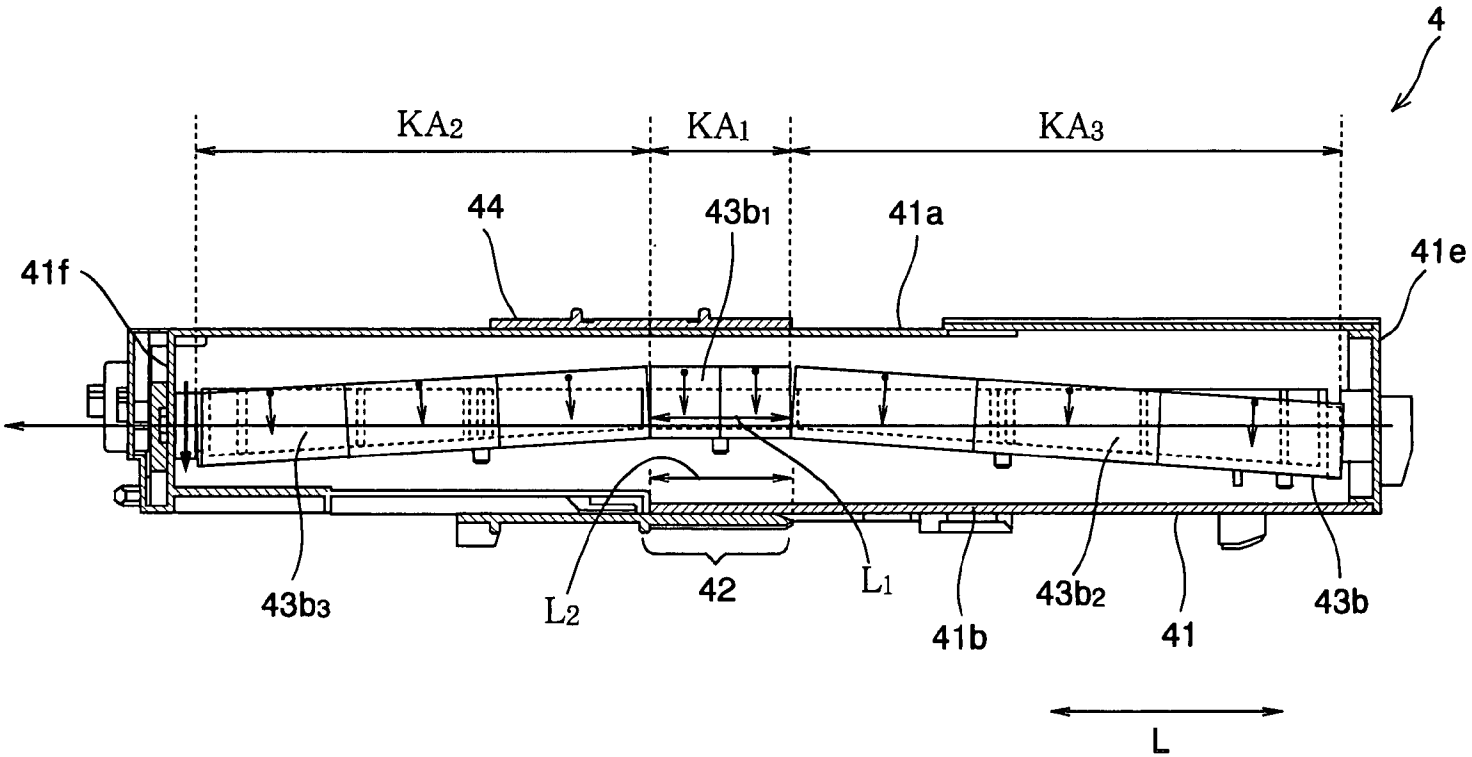
FIG. 8 is a longitudinal sectional view showing the toner cartridge according to the first embodiment, taken along line VIII-VIII in FIG. 2.
Figure 9:
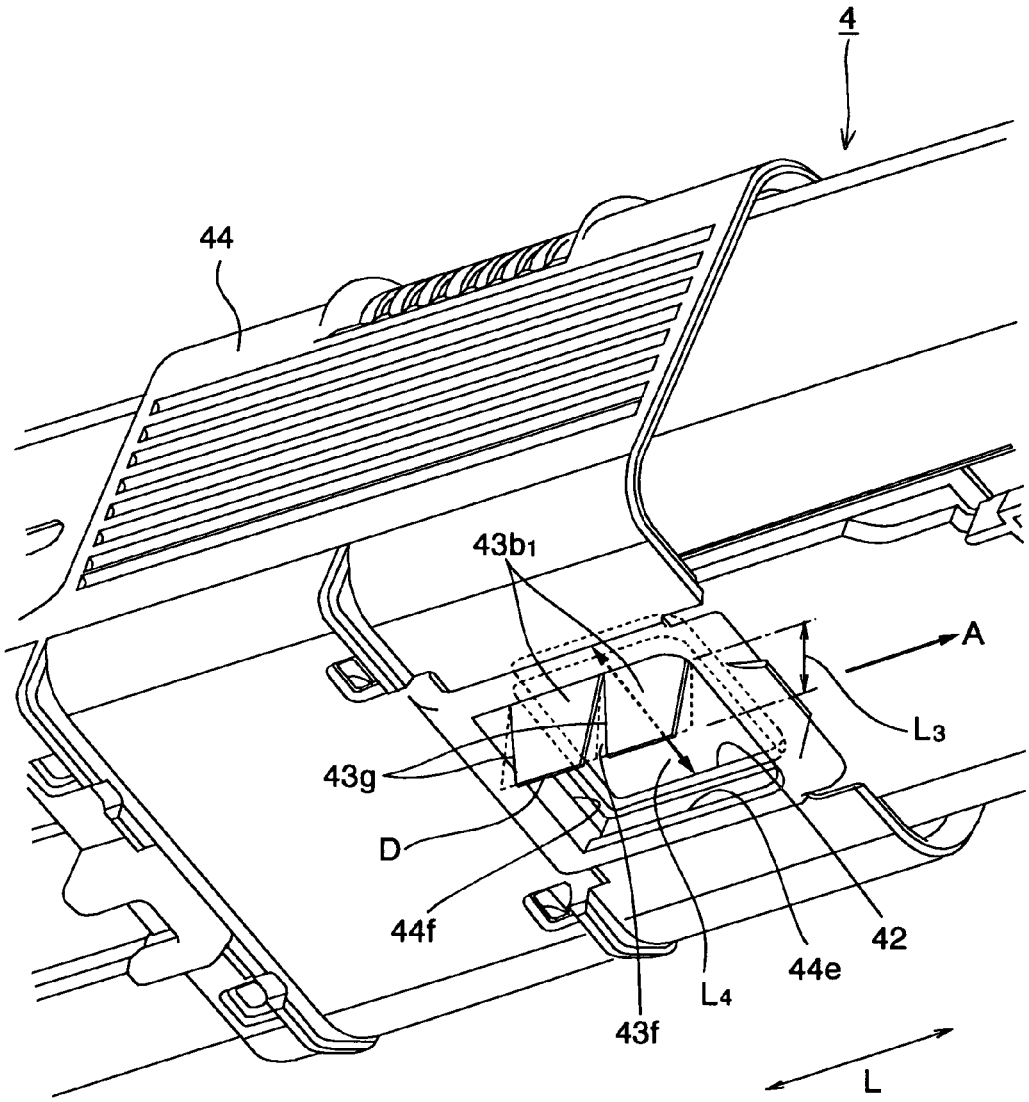
FIG. 9 is a bottom perspective view showing the toner cartridge according to the first embodiment.

FIG. 8 is a longitudinal sectional view of the toner cartridge 4, taken along line VIII-VIII in FIG. 2. FIG. 9 is a bottom perspective view of the toner cartridge 4. As shown in FIG. 8, a length L1 of the agitating portion 43$b_1$ of the first area $KA_1$ in the longitudinal direction is shorter than or equal to a length L2 of the toner supplying opening 42 of the outer frame 41 in the longitudinal direction of the outer frame 41.

Therefore, as shown in FIG. 9, when the agitating portion 43$b_1$ of the first area $KA_1$ is in a position facing the toner supplying opening 42 of the outer frame 41, the agitating portion 43$b_1$ of the first area $KA_1$ protrudes outside the outer frame 41 via the toner supplying opening 42. Further, if the agitating portion 43$b_1$ has a suitable width (i.e. a dimension perpendicular to the center axis of the shaft portion 43*a*), the agitating portion 43$b_1$ of the first area $KA_1$ (protruding outside the outer frame 41 via the toner supplying opening 42) intrudes into the toner hopper 36 disposed below the toner supplying opening 42, and pushes the toner in the toner hopper 36 (more specifically, in the vicinity of the toner receiving opening 36*a*) toward the feeding spiral 36*b*.

As described above, the width of the agitating portion 43*b* in a direction perpendicular to the center axis of the shaft portion 43*a* is determined so that the distance between the center axis of the shaft portion 43*a* and the distal longer edge D of the agitating portion 43*b* is longer than the maximum distance between the center axis of the shaft portion 43*a* and the inner surface of the outer frame 41. Further, the distance between the center axis of the shaft portion 43*a* and the distal longer edge D of the agitating portion 43*b* is longer than a distance between the center axis of the shaft portion 43*a* and the outer surface of the outer frame 41. More preferably, the distance between the center axis of the shaft portion 43*a* and the distal longer edge D of the agitating portion 43*b* is longer than a distance between the center axis of the shaft portion 43*a* and the toner receiving opening 36*a* of the toner hopper 36.

The distance between the center axis of the shaft portion 43*a* and the distal longer edge D of the agitating portion 43*b* has an upper limit so that the agitating portion 43*b* does not contact a device provided in the toner hopper 36 such as the feeding spiral 36.

Referring back to FIG. 7, the slits 43*f* of the agitating portion 43*b* have lengths so as to extend from the distal longer edge D to reach the mounting surface 43. However, the lengths of the slits 43*f* can be arbitrarily determined.

At least one of both sides of the agitating portion 43$b_1$ of the first area $KA_1$ has an inclined portion 43*g* so that a length of the agitating portion 43$b_1$ of the first area $KA_1$ (in a direction of the center axis of the shaft portion 43*a*) decreases toward the distal longer edge D. In other words, the length of the agitating portion 43$b_1$ of the first area $KA_1$ in the direction of the center axis of the shaft portion 43*a* is shorter at the distal longer edge D than at the fixed longer edge F.

In this embodiment, the agitating portion 43$b_1$ of the first area $KA_1$ is divided into two sections by the slit 43*f*. Each section of the agitating portion 43$b_1$ of the first area $KA_1$ has inclined portions 43*g* on both sides.

The inclined portion 43*g* is inclined at an angle $\alpha$ with respect to a widthwise direction of the agitating portion 43 (i.e., a direction perpendicular to the center axis of the shaft portion 43*a*). The angle $\alpha$ is preferably in a range from 10 to 45 degrees, and more preferably in a range from 20 to 30 degrees.

With the provision of the inclined portions 43*g*, when the toner supplying opening shutter 44 is moved in a direction indicated by an arrow A to close the toner supplying opening 42 (in a state where the agitating portion 43$b_1$ of the first area $KA_1$ protrudes outside via the toner supplying opening 42), an inner periphery 44*f* of the toner supplying opening 42 on a rear side in the moving direction A contacts the inclined portion 43*g* of the agitating portion 43$b_1$ of the first area $KA_1$, and pushes the agitating portion 43$b_1$ upward into the toner cartridge 4.

In order to smoothly push the agitating portion 43$b_1$ of the first area $KA_1$ into the toner cartridge 4, it is necessary that a length L3 of the agitating portion 43$b_1$ of the first area $KA_1$ protruding outside the outer frame 41 is shorter than a width L4 (FIG. 9) of the toner supplying opening 42 in the widthwise direction of the toner cartridge 4.

In this embodiment, the agitating portion 43$b_1$ of the first area $KA_1$ has inclined portions 43*g* on both sides (i.e., on the sides facing the second area $KA_2$ and facing the third area $KA_3$) as shown in FIG. 7. However, it is only necessary that the agitating portion 43$b_1$ of the first area $KA_1$ has the inclined portion 43*f* on the side facing the third area $KA_3$ (i.e., the side that contacts the inner periphery 44*f* of the toner supplying opening 42).

In this regard, a length of the inclined portion 43*f* in the direction perpendicular to the center axis of the shaft portion 43*a* is longer than a length by which the agitating portion 43$b_1$ of the first area $KA_1$ protrudes outside the outer frame 41 via the toner ejection opening 44*e*.

As described above, the mounting surface 43$e_1$ of the first area $TA_1$ is a surface whose normal line is perpendicular to the center axis of the shaft portion 43*a*. The mounting surface 43$e_2$ of the second area $TA_2$ is inclined so that a distance from the center axis of the shaft portion 43*a* increases toward the first pin 43*c*. The mounting surface 43$e_3$ of the third area $TA_3$ is inclined so that a distance from the center axis of the shaft portion 43*a* increases toward the second pin 43*d*. Further, the agitating portion 43*b* has the first area $KA_1$, the second area $KA_2$ and the third area $KA_3$ respectively corresponding to the first area $TA_1$, the second area $TA_2$ and the third area $TA_3$ of the mounting surface 43*e*.

With such a configuration, as shown in FIG. 8, the agitating portion 43$b_2$ of the second area $KA_2$ and the agitating portion 43$b_3$ of the third area $KA_3$ are inclined toward the agitating portion 43$b_1$ of the first area $KA_1$. Therefore, when the shaft portion 43*a* rotates about the center axis, the toner is pushed by the agitating portion 43$b_2$ of the second area $KA_2$ and the agitating portion 43$b_3$ of the third area $KA_3$ and moves toward the agitating portion 43$b_1$ of the first area $KA_1$. Thus, the toner is collected at the first area $KA_1$, and is supplied to outside via the toner supplying opening 42 (disposed on a position corresponding to the first area $KA_1$).

An operation of the toner cartridge 4 mounted to the developing unit 3 will be described with reference to FIG. 10.

Figure 10:
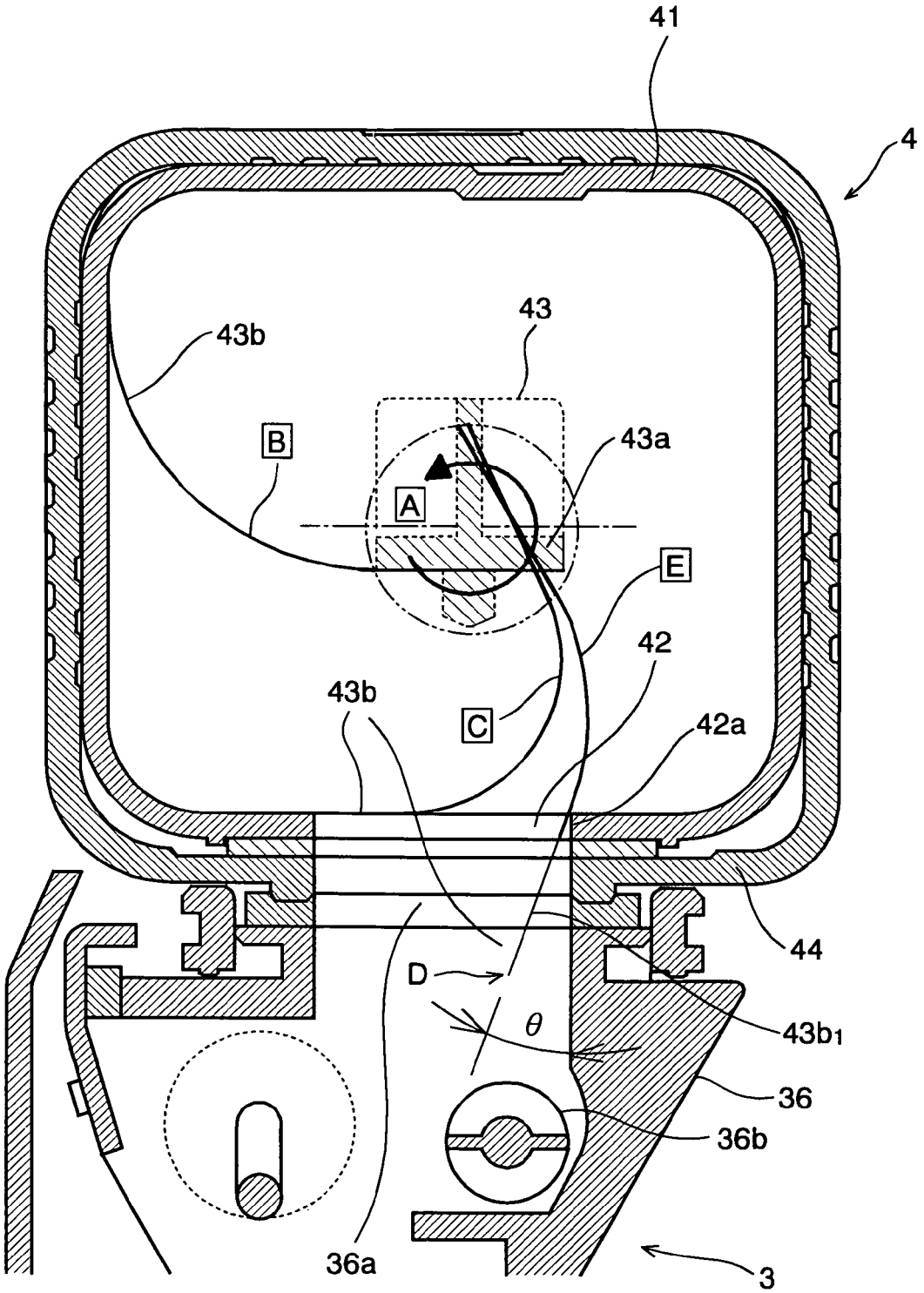
FIG. 10 is a cross sectional view for illustrating an operation of the toner cartridge mounted to the developing unit according to the first embodiment.

FIG. 10 is a cross sectional view for illustrating the operation of the toner cartridge 4 mounted to the developing unit 3, taken along line X-X in FIG. 4. In FIG. 10, reference marks B, C and E indicate respective states of the agitating portion 43*b* as the agitating-and-supplying member 43 rotates in the direction indicated by the arrow A about the center axis of the shaft portion 43*a*.

First, as the agitating-and-supplying member 43 rotates in the direction indicated by the arrow A about the center axis, the agitating portion 43*b* (of the areas $KA_1$, $KA_2$ and $KA_3$) contacts the inner surface of the outer frame 41 in such a manner that the agitating portion 43*b* is deflected as indicated by a reference mark "B". A deflecting direction of the agitating portion 43*b* is opposite to the rotating direction of the agitating-and-supplying member 43. With this rotation, the agitating-and-supplying member 43 conveys the toner (stored in the outer frame 41) in the rotating direction indicated by the arrow A.

In this regard, if a large amount of the toner is stored in the outer frame 41, there may be cases where the agitating portion 43*b* does not contacts the inner surface of the outer frame 41.

As the agitating-and-supplying member 43 further rotates in the direction indicated by the arrow A about the center axis, a tip (i.e., the distal longer end D) of the agitating portion 43$b_1$ of the first area $KA_1$ reaches the toner supplying opening 42 of the outer frame 41 as indicated by a reference mark "C" in FIG. 10. Further, due to the resilient force of the agitating portion 43$b_1$, the agitating portion 43$b_1$ of the first area $KA_1$ instantly changes its shape as indicated by a reference mark "E" in FIG. 10.

In this state, the tip of the agitating portion 43$b_1$ of the first area $KA_1$ becomes free from contact with the inner surface of the outer frame 41.

As the agitating portion 43$b_1$ of the first area $KA_1$ changes its shape as indicated by the reference mark "E" to release its deflection, the agitating portion 43$b_1$ pushes the toner into the toner hopper 36. Further, the agitating portion 43$b_1$ disperses the toner stagnating in the vicinity of the toner receiving opening 36*a* of the toner hopper 36, and pushes the toner into the toner hopper 36 (to be more specific, toward the feeding spiral 36*b*).

When the agitating portion 43$b_1$ of the first area $KA_1$ is in a state shown by the reference mark "E", the agitating portion 43$b_1$ contacts an inner periphery 42*a* of the toner supplying opening 42. The tip (i.e., the distal longer edge D) of the agitating portion 43$b_1$ positions at a rear side with respect to the inner periphery 42*a* of the toner supplying opening 42 in a rotating direction of the agitating-and-supplying member 43. An angle θ (which is greater than 0) is formed between the agitating portion 43$b_1$ and the inner periphery 42*a* of the toner supplying opening 42. When the toner supplying opening shutter 44 is moved to close the toner supply opening 42 in a state where the agitating portion 43$b_1$ protrudes outside the outer frame 41, the toner supplying opening shutter 44 pushes the inclined portion 43*g* of the agitating portion 43$b_1$ of the first area $KA_1$, so that the agitating portion 43$b_1$ of the first area $KA_1$ is pushed into the outer frame 41. Thus, the agitating portion 43*b* is not nipped by the toner supplying opening shutter 44 and the outer frame 41.

When the agitating-and-supplying member 43 further rotates in the direction indicated by the arrow A from the state indicated by the reference mark "E", the agitating portion 43$b_1$ of the first area $KA_1$ is deflected in a direction to increase its deflection, and is retracted inside the outer frame 41.

As described above, according to the first embodiment, the agitating portion 43*b* of the agitating-and-supplying member 43 protrudes outside the toner cartridge 4 and intrudes into the toner hopper 36 via the toner supplying opening 42, and therefore the stagnation of the toner in the toner hopper 36 (more specifically, in the vicinity of the toner receiving opening 36*a*) can be prevented.

Second Embodiment

Next, the second embodiment of the present invention will be described. The second embodiment is different from the first embodiment in the structure of the agitating-and-supplying member 43 (243). Hereinafter, an agitating-and-supplying member 243 according to the second embodiment and its related components will be described.

Figure 11:
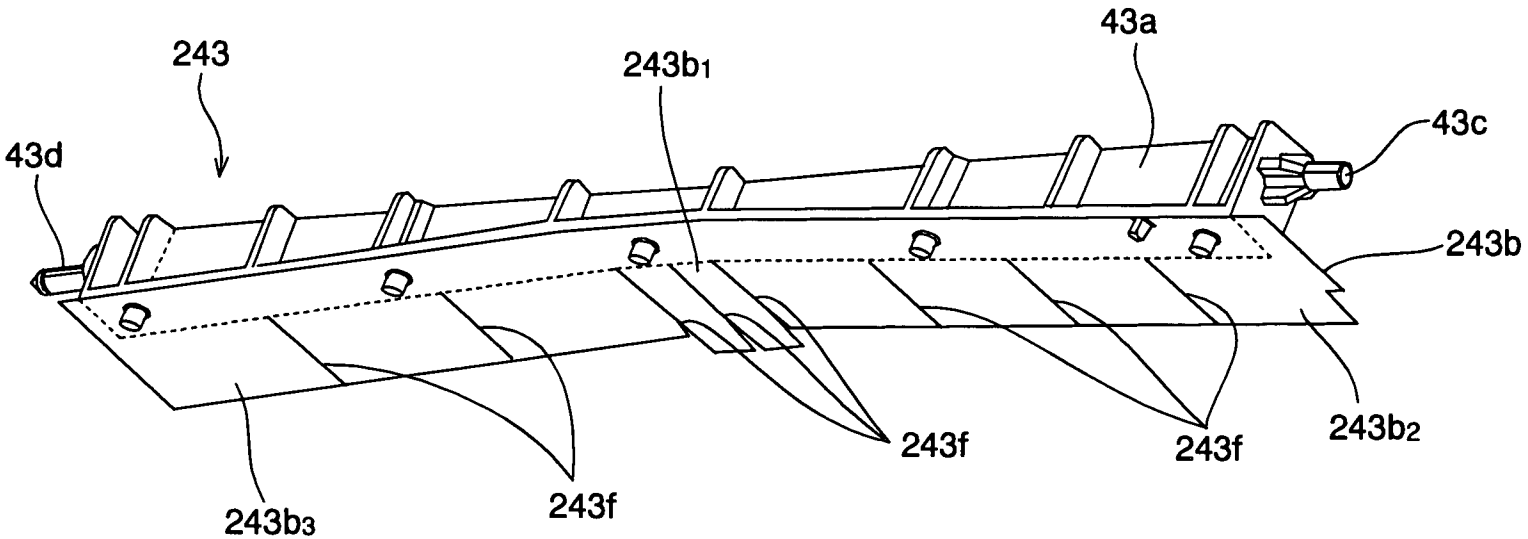
FIG. 11 is a perspective view showing an agitating-and-supplying member according to the second embodiment.

FIG. 11 is a perspective view showing the agitating-and-supplying member 243 of the second embodiment of the present invention. As shown in FIG. 11, the agitating-and-supplying member 243 includes a shaft portion 43*a* and an agitating portion 243*b*. The shaft portion 43*a* is the same as that of the first embodiment, but the agitating portion 243*b* is different from the agitating portion 43*b* of the first embodiment. Therefore, a structure of the agitating portion 243*b* will be described.

Figure 12:
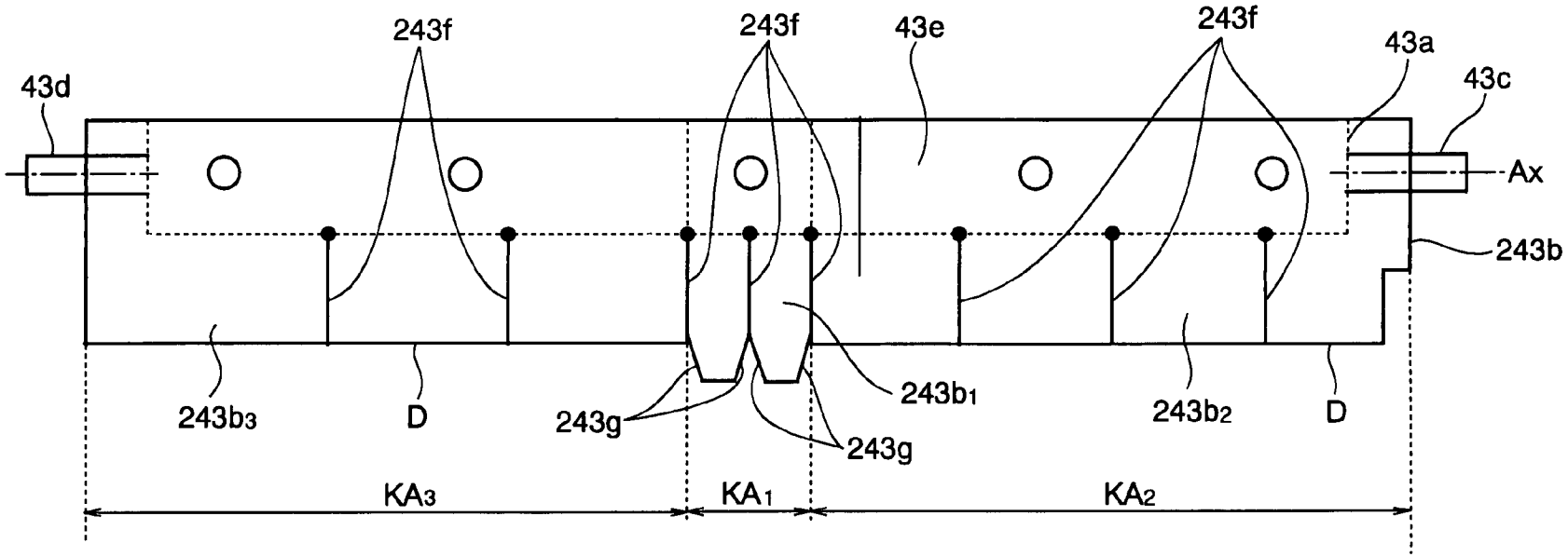
FIG. 12 is a front view showing the agitating-and-supplying member according to the second embodiment.

FIG. 12 is a front view of the agitating portion 243*b*. As shown in FIG. 12, a longitudinal direction of the agitating portion 243*b* is parallel to the center axis of the shaft portion 43*a*. An end of the agitating portion 243*b* in a direction perpendicular to the center axis of the shaft portion 43*a* (i.e., a fixed longer edge F) is fixed to the mounting surface 43*e* of the shaft portion 43*a* as in the first embodiment. Another longer edge of the agitating portion 243*b* (opposite to the fixed longer edge F) will be referred to as a distal longer edge D.

The agitating portion 243*b* has the first area $KA_1$, the second area $KA_2$ and the third area $KA_3$ separated by slits 243*f* as described in the first embodiment. A width of the agitating portion 243$b_1$ of the first area $KA_1$ (in the direction perpendicular to the center axis of the shaft portion 43*a*) is the same as that of the first embodiment. In contrast, the widths (in the direction perpendicular to the center axis of the shaft portion 43*a*) of the agitating portion 243*$b_2$* of the second area $KA_2$ and the agitating portion 243*$b_3$* of the third area $KA_3$ are shorter than those of the first embodiment.

In this regard, in a state where the agitating portion 243 is held in a flat shape as shown in FIG. 12, a distance between the center axis (Ax) of the shaft portion 43*a* and the distal longer edge D of the agitating portion 243*$b_2$* of the second area $KA_2$ is longer than a maximum distance between the center axis of the shaft portion 43*a* and the inner surface of the outer frame 41. Further, a distance between the center axis (Ax) of the shaft portion 43*a* and the distal longer edge D of the agitating portion 243*$b_3$* of the third area $KA_3$ is longer than the maximum distance between the center axis of the shaft portion 43*a* and the inner surface of the outer frame 41. That is, the agitating portion 243*$b_2$* of the second area $KA_2$ and the agitating portion 243*$b_3$* of the third area $KA_3$ both contact the inner surface of the outer frame 41.

When the agitating portion 243*b* rotates contacting the inner surface of the outer frame 41, deflection amounts of the agitating portion 243*$b_2$* of the second area $KA_2$ and the agitating portion 243*$b_3$* of the third area $KA_3$ are relatively small, since the agitating portion 243*$b_2$* of the second area $KA_2$ and the agitating portion 243*$b_3$* of the third area $KA_3$ are relatively short as described above. Therefore, the agitating portion 243*$b_2$* of the second area $KA_2$ and the agitating portion 243*$b_3$* of the third area $KA_3$ sweep the toner (stored in the outer frame 41) with a relatively small deflection, as compared with the agitating portion 43 of the first embodiment. Thus, the agitating portion 243*$b_2$* of the second area $KA_2$ and the agitating portion 243*$b_3$* of the third area $KA_3$ sweep the toner in a relatively upright manner, as compared with the agitating portion 43 of the first embodiment. As a result, the toner can efficiently be swept.

Further, even when the agitating portion 243*$b_2$* of the second area $KA_2$ and the agitating portion 243*$b_3$* of the third area $KA_3$ contact the inner surface of the outer frame 41, the agitating portion 243*$b_2$* of the second area $KA_2$ and the agitating portion 243*$b_3$* of the third area $KA_3$ can still be further deformed. Therefore, a resistance to the rotation of the agitating-and-supplying member 243 caused by the toner in the outer frame 41 is reduced by the deformation of the agitating portion 243*$b_2$* of the second area $KA_2$ and the agitating portion 243*$b_3$* of the third area $KA_3$, with the result that a rotational load of the agitating-and-supplying member 243 is reduced.

As described in the first embodiment, the length of the agitating portion 243*$b_1$* of the first area $KA_1$ (in the longitudinal direction of the agitating portion 243*b*) is shorter than the length of the toner supplying opening 42 in the longitudinal direction of the outer frame 41, so that the agitating portion 243*$b_1$* of the first area $KA_1$ can enter into the toner hopper 36.

Further, as described in the first embodiment, at least one of both sides of the agitating portion 243*$b_1$* of the first area $KA_1$ has an inclined portion 243*g* so that a length of the agitating portion 243*$b_1$* of the first area $KA_1$ (in the direction of the center axis of the shaft portion 43*a*) decreases toward the distal longer edge D. In other words, the length of the agitating portion 243*$b_1$* of the first area $KA_1$ in the direction of the center axis of the shaft portion 43*a* is shorter at the distal longer edge D than at the fixed longer edge F.

Figure 13:
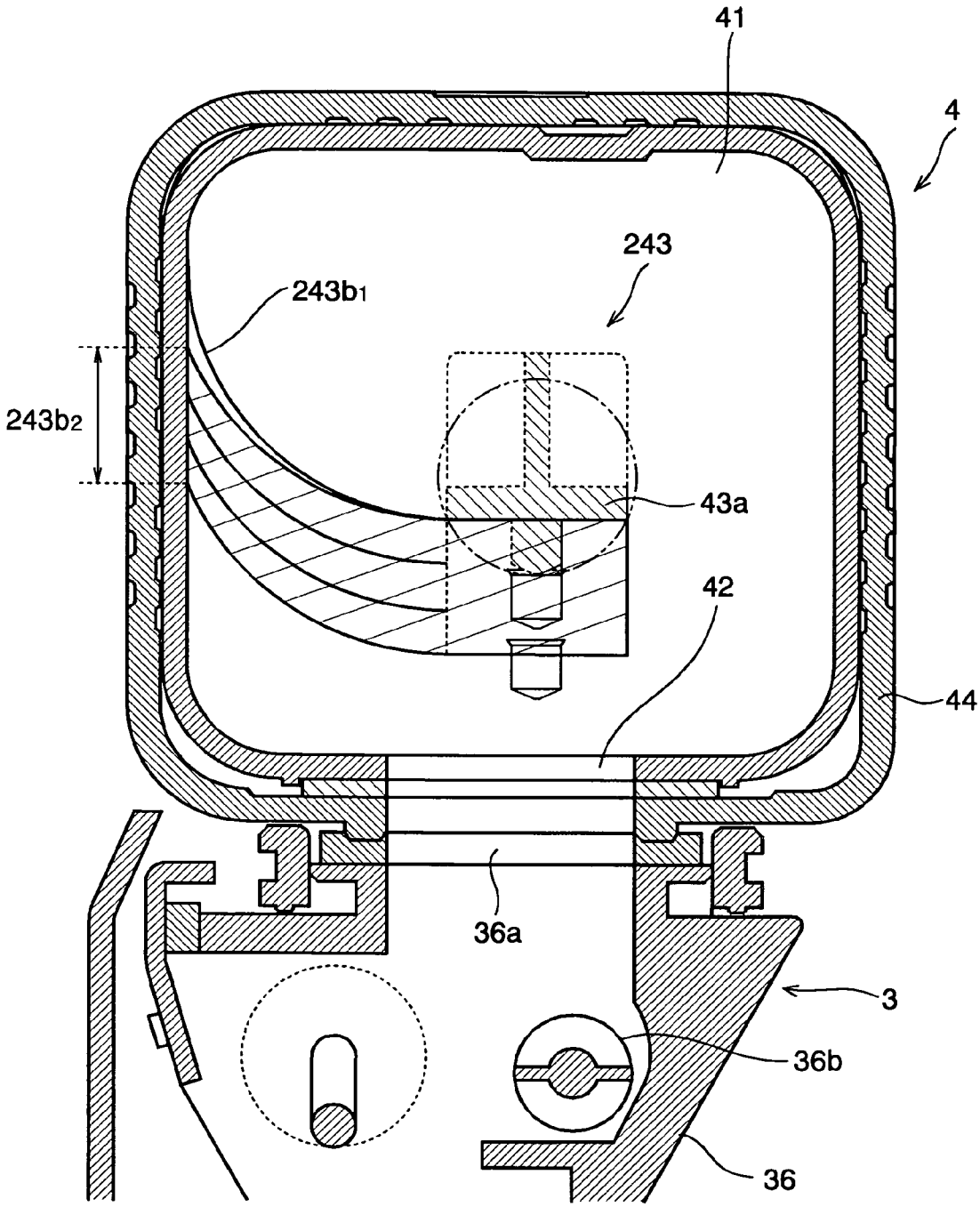
FIG. 13 is a cross sectional view showing a toner cartridge and a developing unit according to the second embodiment, taken along line VIII-VIII in FIG. 2.

FIG. 13 is a cross sectional view showing the toner cartridge 4 mounted to the developing unit 3, corresponding to the cross section taken along line X-X in FIG. 4. As shown in FIG. 13, according to the second embodiment, the agitating portion 243*$b_2$* of the second area $KA_2$ and the agitating portion 243*$b_3$* of the third area $KA_3$ are less deformed than the agitating portion 243*$b_1$* of the first area $KA_1$ while sweeping the toner stored in the outer frame 41. That is, the agitating portion 243*$b_2$* of the second area $KA_2$ and the agitating portion 243*$b_3$* of the third area $KA_3$ sweep the toner in a relatively upright manner. Therefore, the toner can be efficiently swept. Further, since the agitating portion 243*$b_2$* of the second area $KA_2$ and the agitating portion 243*$b_3$* of the third area $KA_3$ can be further deformed even when the agitating portion 243*$b_2$* of the second area $KA_2$ and the agitating portion 243*$b_3$* of the third area $KA_3$ contact the inner surface of the outer frame 41, a resistance to the rotation of the agitating-and-supplying member 243 (caused by the toner) can be reduced, and a rotational load of the agitating-and-supplying member 243 is reduced.

Third Embodiment

Next, the third embodiment of the present invention will be described.

The third embodiment is different from the first embodiment in structure of the agitating-and-supplying member 43 (343). Hereinafter, an agitating-and-supplying member 343 of the third embodiment and its related components will be described.

Figure 14:
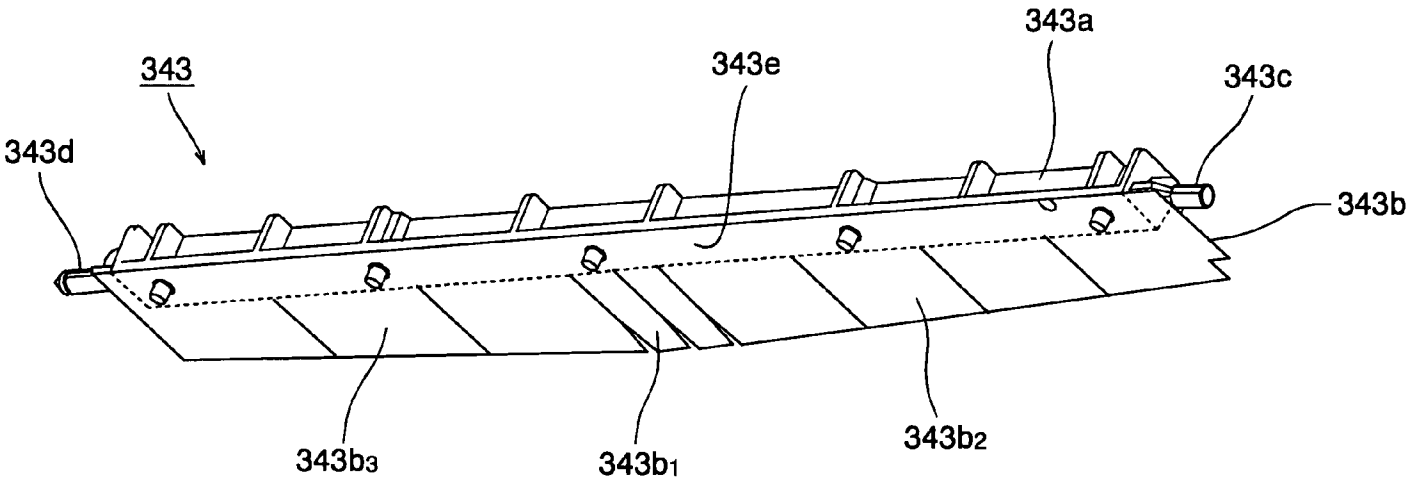
FIG. 14 is a perspective view showing an agitating-and-supplying member according to the third embodiment.

FIG. 14 is a perspective view showing the agitating-and-supplying member 343 according to the third embodiment of the present invention. As shown in FIG. 14, the agitating-and-supplying member 343 includes a shaft portion 343*a* and an agitating portion 343*b*. Hereinafter, differences between the agitating-and-supplying member 343 of the third embodiment and the agitating-and-supplying member 43 of the first embodiment will be described.

Figure 15:
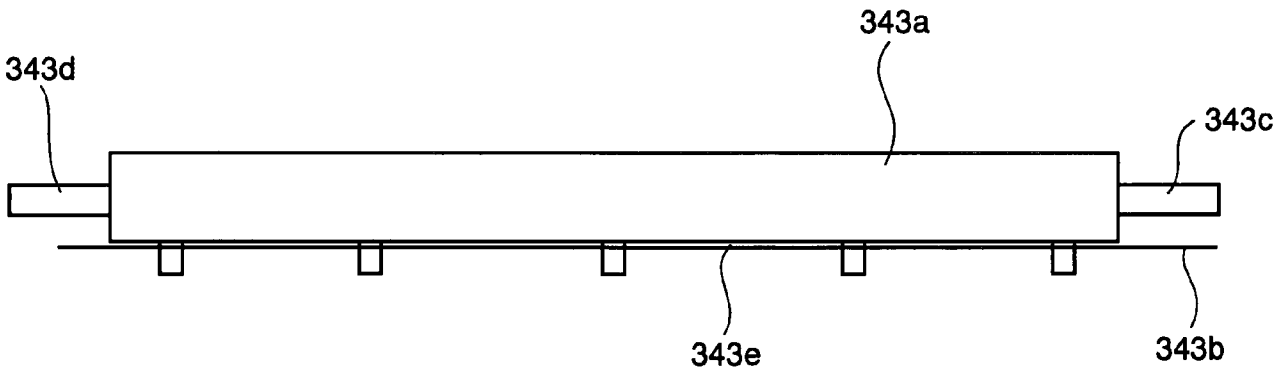
FIG. 15 is a bottom view showing the agitating-and-supplying member according to the third embodiment.

FIG. 15 is a bottom view of the agitating-and-supplying member 343. As shown in FIG. 15, the shaft portion 343*a* linearly extends, and has first and second pins 343*c* and 343*d* are provided on both ends in the longitudinal direction. The pins 343*c* and 343*d* (i.e., supporting pins) are inserted into the shaft-holes formed on the inner sides of the third side wall 41*e* and the fourth side wall 41*f* (see, FIG. 8) of the outer frame 41, so that the shaft portion 343*a* is rotatable about the center axis.

Referring back to FIG. 14, the shaft portion 343*a* has a mounting surface 343*e* extending in a direction of the center axis of the shaft portion 343*a*. Unlike the mounting surface 43*e* of the first embodiment, the mounting surface 343 is formed as a flat surface.

The agitating portion 343*b* is fixed to the mounting surface 343*e* using a fixing means such as an adhesive agent.

Figure 16:
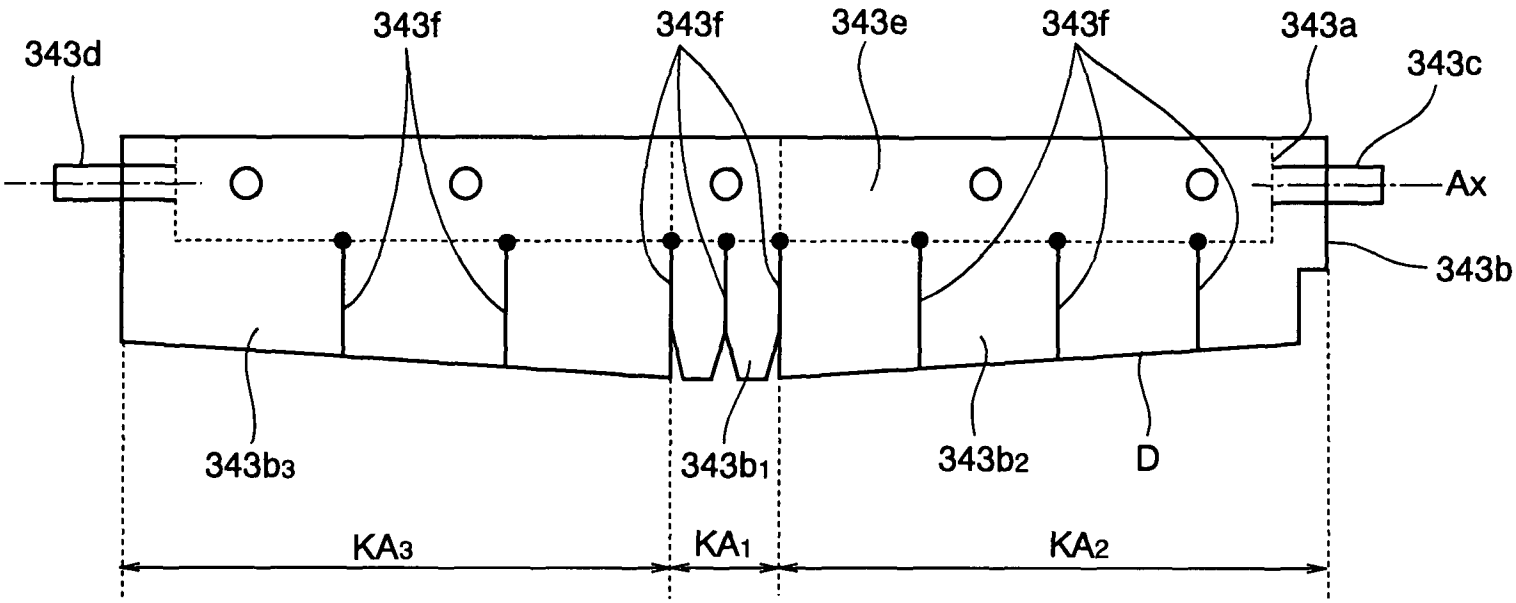
FIG. 16 is a front view showing the agitating-and-supplying member according to the third embodiment.

FIG. 16 is a front view of the agitating portion 343*b*. As shown in FIG. 16, a longitudinal direction of the agitating portion 343*b* is parallel to the center axis of the shaft portion 343*a*. An end of the agitating portion 343*b* in a direction perpendicular to the center axis of the shaft portion 343*a* (i.e., a fixed longer edge F) is fixed to the mounting surface 343*e* of the shaft portion 343*a*. Another longer edge of the agitating portion 343*a* (opposite to the fixed longer edge F) will be referred to as a distal longer edge D.

The shaft portion 343*b* has a first area $KA_1$, a second area $KA_2$ and a third area $KA_3$ separated by slits 343*f* as described in the first embodiment. A width of the agitating portion 343*$b_1$* of the first area $KA_1$ (in the direction perpendicular to the center axis of the shaft portion 343*a*) is the same as that of the first embodiment. In contrast, a width of the agitating portion 343*$b_2$* of the second area $KA_2$ gradually decreases toward the first pin 343*c*. Further, a width of the agitating portion 343*$b_3$* of the third area $KA_3$ gradually decreases toward the second pin 343*d*. In other words, a distance between the center axis of the shaft portion 343*a* and the distal longer edge D of the agitating portion 343*$b_2$* of the second area $KA_2$ gradually decreases toward the first pin 343*c*. A distance between the center axis of the shaft portion 343*a* and the distal longer edge D of the agitating portion 343$b_3$ of the third area $KA_3$ gradually decreases toward the second pin 343*d*.

In this regard, in a state where the agitating portion 343 is held in a flat shape as shown in FIG. 16, the distance between the center axis of the shaft portion 343*a* and the distal longer edge D of the agitating portion 343$b_2$ of the second area $KA_2$ is longer than a maximum distance between the center axis of the shaft portion 343*a* and the inner surface of the outer frame 41. Further, the distance between the center axis of the shaft portion 343*a* and the distal longer edge D of the agitating portion 343$b_3$ of the third area $KA_3$ is longer than the maximum distance between the center axis of the shaft portion 343*a* and the inner surface of the outer frame 41. That is, the agitating portion 343$b_2$ of the second area $KA_2$ and the agitating portion 343$b_3$ of the third area $KA_3$ both contact the inner surface of the outer frame 41.

With such a configuration, in a state where the agitating-and-supplying member 343 is mounted in the toner cartridge 4, the agitating portion 343*b* contacts the inner surface of the outer frame 41 in a deflected manner. Due to the above described widths of the agitating portion 343$b_2$ of the second area $KA_2$ and the agitating portion 343$b_3$ of the third area $KA_3$, the deflection amounts of the agitating portion 343$b_2$ of the second area $KA_2$ and the agitating portion 343$b_3$ of the third area $KA_3$ decrease toward either end of the agitating portion 343*b* in the longitudinal direction.

Figure 17:
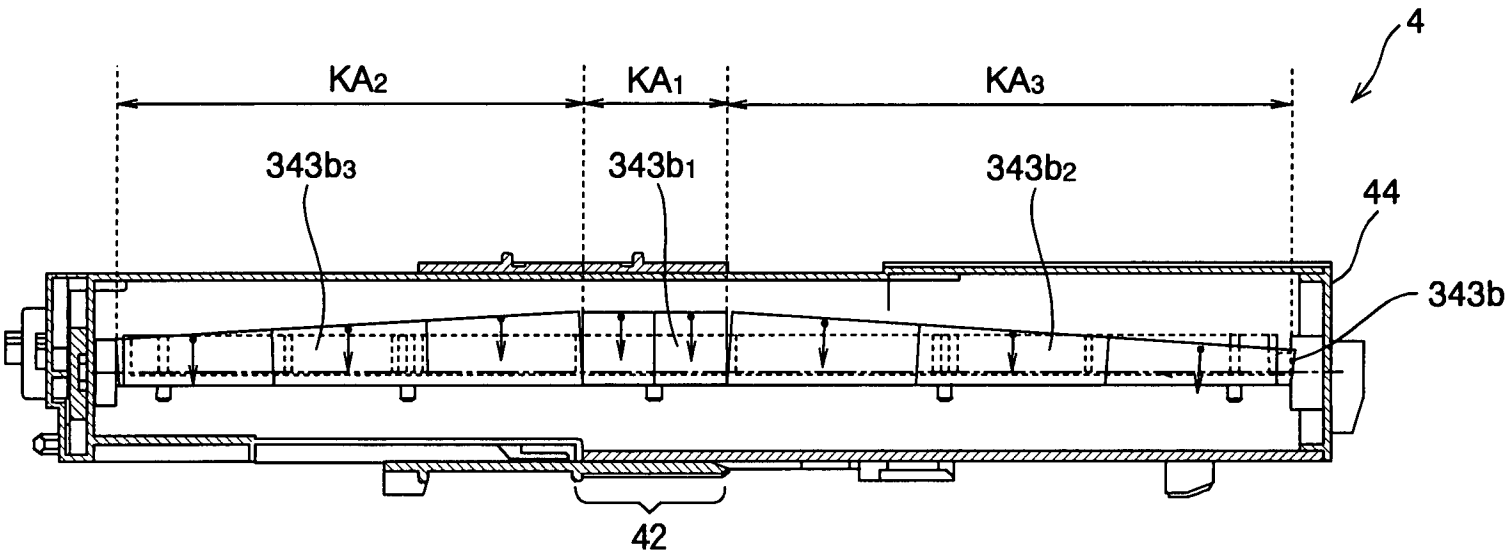
FIG. 17 is a longitudinal sectional view showing a toner cartridge according to the third embodiment, taken along line VIII-VIII in FIG. 2.

FIG. 17 is a longitudinal sectional view of the toner cartridge 4, taken along line VIII-VIII in FIG. 2. As shown in FIG. 17, outside parts (in the longitudinal direction of the agitating portion 343*b*) of the agitating portion 343$b_2$ of the second area $KA_2$ and the agitating portion 343$b_3$ of the third area $KA_3$ sweep the toner stored in the outer frame 41 in a relatively upright manner, and therefore a resistance to the rotation of the agitating-and-supplying member 343 (caused by the toner) is reduced, so that a rotational load of the agitating-and-supplying member 343 is reduced.

Further, during the rotation of the agitating-and-supplying member 343, the agitating portion 343$b_2$ of the second area $KA_2$ and the agitating portion 343$b_3$ of the third area $KA_3$ shift ahead of (i.e., to a front side of) the agitating portion 343$b_1$ of the first area $KA_1$ in the rotating direction of the agitating portion 343. Thus, the toner is caused to move from the agitating portion 343$b_2$ of the second area $KA_2$ and the agitating portion 343$b_3$ of the third area $KA_3$ toward the agitating portion 343$b_1$ of the first area $KA_1$. The toner in the outer frame 41 is collected at the agitating portion 343$b_1$ of the first area $KA_1$, and is supplied to the toner hopper 36 via the toner supplying opening 42. Therefore, the toner stored in the outer frame 41 is efficiently supplied to the toner hopper 36 via the toner supplying opening 42.

In the third embodiment, the agitating portion 343*b* is fixed to the mounting surface 343*e* of the shaft portion 343*a* formed as a flat surface. However, it is also possible to mount the agitating portion 343*b* to a linearly extending shaft connecting the first and second pins 343*c* and 343*d*. Alternatively, it is also possible to mount the agitating portion 343*b* to the mounting surface 43*e* with inclined surfaces (see FIG. 6) as described in the first embodiment.

Fourth Embodiment

Next, the fourth embodiment of the present invention will be described. The fourth embodiment is different from the first embodiment in structures of the toner supplying opening shutter 44 (444) and the agitating portion 43*b* (443*b*). Hereinafter, a toner supplying opening shutter 444 and an agitating portion 443*b* of the fourth embodiment and their related components will be described.

Figure 18:
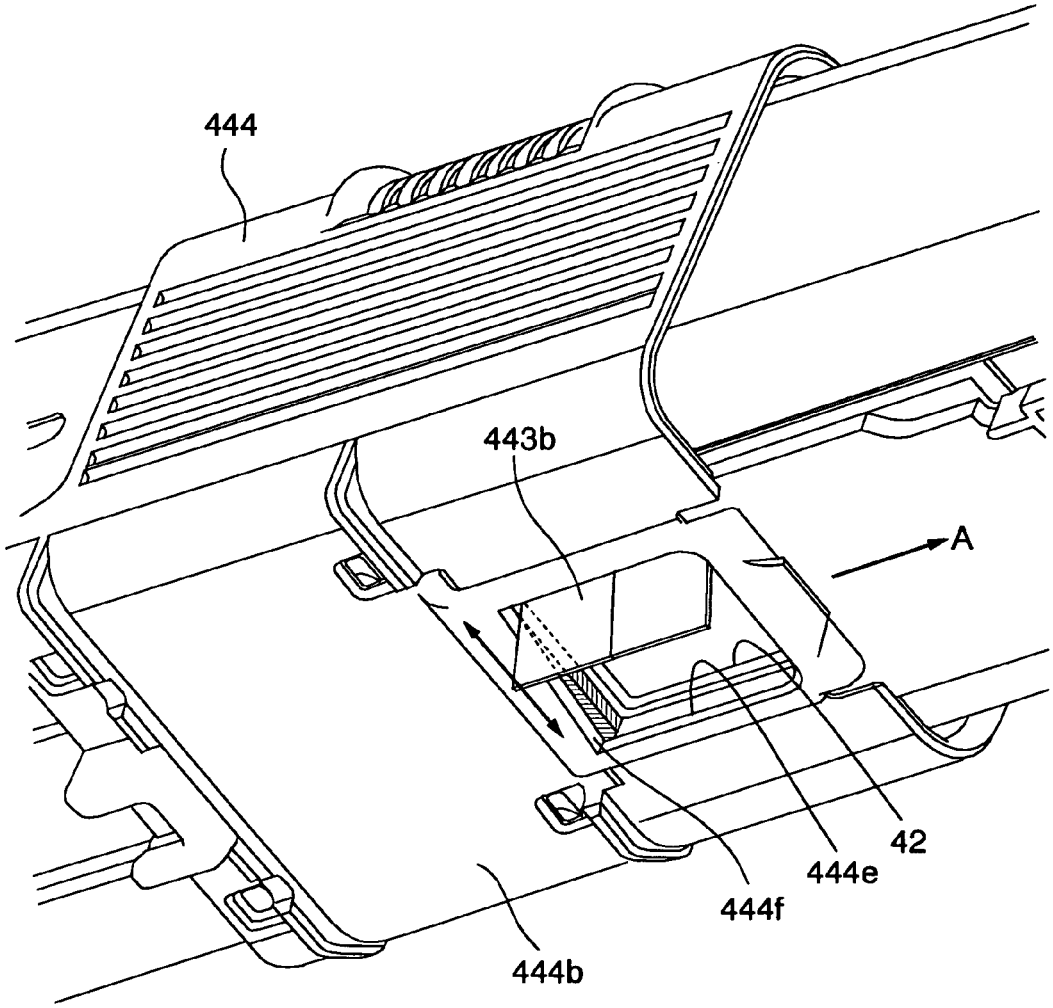
FIG. 18 is a bottom perspective view showing a toner supplying opening shutter and an agitating portion according to the fourth embodiment.

FIG. 18 is a bottom perspective view showing the toner supplying opening shutter 444 and the agitating portion 443*b*. As shown in FIG. 18, the toner supplying opening shutter 444 of the fourth embodiment has the ejection opening 444*e* formed on the bottom wall 444*b*. An inner periphery 444*f* of the ejection opening 444*e* (on a rear side in the moving direction of the toner supplying opening shutter 444 to close the toner supplying opening 444*e*) is inclined with respect to the moving direction of the toner supplying opening shutter 444.

Figure 19:
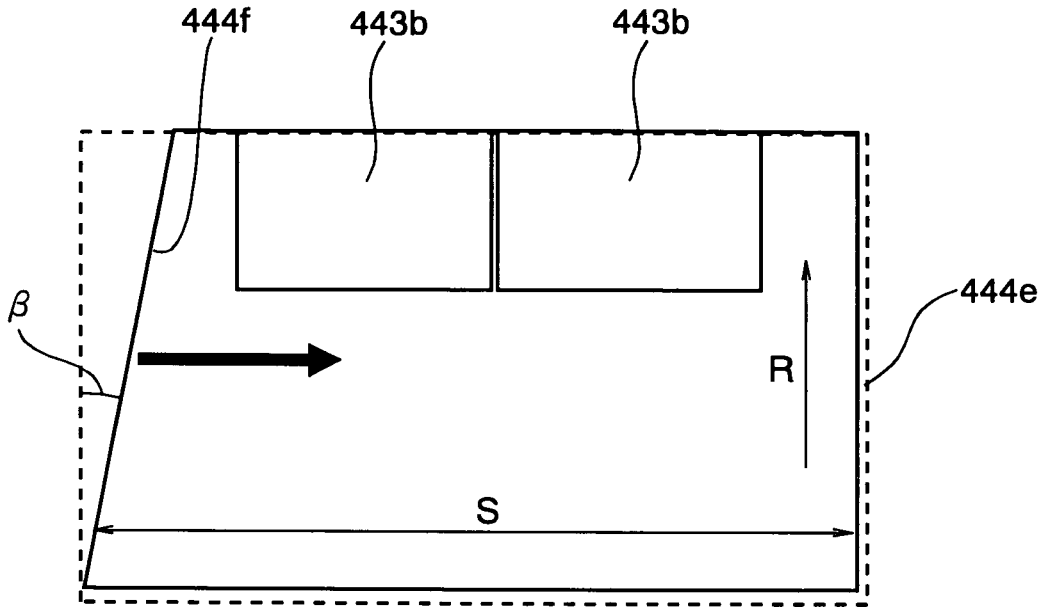
FIG. 19 is a bottom view showing a toner ejection opening according to the fourth embodiment.

FIG. 19 is a bottom view showing the toner ejection opening 444*e*. The inner periphery 444*f* of the toner ejection opening 444*e* is inclined so that an opening length (indicated by an arrow S) of the ejection opening 444*e* in the longitudinal direction of the outer frame 41 decreases in a rotating direction of the agitating portion 443*b* (indicated by an arrow R). In other words, the opening length S of the ejection opening 444*e* is shorter at a front side (i.e., a downstream side) in the rotating direction of the agitating portion 443*b* than at a rear side (i.e., an upstream side) in the rotating direction of the agitating portion 443*b*.

An angle β of the inner periphery 444*f* with respect to a widthwise direction of the toner supplying opening shutter 444 (perpendicular to the movable direction of the toner supplying opening shutter 444) is preferably in a range from 10 to 45 degrees, and more preferably in a range from 20 to 30 degrees.

The agitating portion 443*b* of the fourth embodiment is different from the agitating portion 43*b* of the first embodiment in that the agitating portion 443*b* has no inclined portion 43*g* (FIG. 7). The agitating portion 443*b* of the fourth embodiment is the same as the agitating portion 43*b* of the first embodiment in other respects.

As described above, according to the fourth embodiment, the inner periphery 444*f* of the toner ejection opening 444*e* on the rear side in the moving direction of the toner supplying opening shutter 444 for closing the toner supplying opening 42 is inclined as described above. Therefore, when the toner supplying Opening shutter 444 is moved to close the toner supplying opening 42 in a state where the agitating portion 443*b* protrudes outside the outer frame 41 via the toner supplying opening 42 and the toner ejection opening 444*e*, the inner periphery 444*f* of the toner ejection opening 444*e* contacts a side edge of the agitating portion 443*b*, and pushes the agitating portion 443*b* into the outer frame 41. Thus, the agitating portion 443*b* is not nipped by the toner supplying opening shutter 444 and the outer frame 41.

Further, according to the fourth embodiment, the agitating portion 443*b* is not required to have the inclined portion 43*g* (FIG. 7). Therefore, a relatively large area of the agitating portion 443*b* protrudes into the toner hopper 36 via the toner supplying opening 42 and the toner ejection opening 444*e*. Thus, the toner stored in the toner hopper 36 is efficiently pushed toward the feeding spiral 36*a* (FIG. 2).

While the preferred embodiments of the present invention have been illustrated in detail, it should be apparent that modifications and improvements may be made to the invention without departing from the spirit and scope of the invention as described in the following claims.

What is claimed is:

1. A developer storage container comprising:

a developer storage portion that stores a developer and has an opening for supplying said developer to outside of said developer storage portion; and an agitating-and-supplying member rotatably provided in said developer storage portion, said agitating-and-supplying member having a shaft portion and an agitating portion, said agitating portion having a fixed end and a distal end opposite to each other, said fixed end of said agitating portion being fixed to said shaft portion;

wherein said agitating portion has an area corresponding to said opening;

wherein said agitating portion of said area includes a protruding part that protrudes outside of said developer storage portion via said opening;

wherein a length of said distal end of said protruding part of said agitating portion of said area is shorter than a length of a portion of the protruding part shifted from said distal end toward said rotation axis, said length of said distal end and said length of said portion being defined in a direction parallel to a rotation axis of said shaft portion; and wherein, in said area, a distance between said rotation axis of said shaft portion and said distal end of said agitating portion is longer than a distance between said rotation axis of said shaft portion and an outer wall of said developer storage portion.

2. The developer storage container according to claim 1, wherein said agitating portion is constituted by a resilient member that protrudes from said shaft portion toward an inner surface of said developer storage portion.

3. The developer storage container according to claim 2, wherein said agitating portion is formed of a film member, and said agitating portion contacts said inner surface of said developer storage portion in a deflected manner.

4. The developer storage container according to claim 1, wherein said agitating portion contacts said inner surface of said developer storage portion in a deflected manner.

5. The developer storage container according to claim 4, wherein said agitating portion of said area is separated from said agitating portion of other area by slits.

6. The developer storage container according to claim 1, wherein said length of said agitating portion of said area is shorter than a length of said opening in the same direction.

7. The developer storage container according to claim 4, wherein a distance between said fixed end and said distal end of said agitating portion of said area is longer than a distance between said fixed end and said distal end of said agitating portion of other area.

8. The developer storage container according to claim 1, wherein a distance between said fixed end to said distal end of said agitating portion gradually decreases as a distance from said area increases.

9. The developer storage container according to claim 1, further comprising a shutter provided on said developer storage portion so as to be movable in a longitudinal direction of said developer storage portion, wherein said shutter is movable between a first position where said shutter covers said opening, and a second position where said shutter opens said opening.

10. The developer storage container according to claim 4, wherein, in a state where said agitating portion of said area protrudes outside said developer storage portion via said opening, said agitating portion of said area contacts an inner periphery of said opening, and said distal end of said agitating portion positions at a rear side with respect to said inner periphery of said opening in a rotating direction of said agitating-and-supplying member.

11. The developer storage container according to claim 1, wherein said length of said agitating portion is shorter at said distal end than at said fixed end.

12. A developing device comprising said developer storage container according to claim 1.

13. An image forming apparatus comprising said developer storage container according to claim 1.

14. The developer storage container according to claim 1, wherein said length of said protruding part of said agitating portion gradually decreases in a direction from said opening toward said distal end of said protruding part.

15. The developer storage container according to claim 9, wherein said protruding part of said agitating portion protruding via said opening has an inclined part that is inclined with respect to a moving direction of said shutter.

16. The developer storage container according to claim 15, wherein said inclined part is inclined so that a distance between said opening and said inclined part in said moving direction of said shutter increases in a direction from said opening toward said distal end.

17. The developer storage container according to claim 1, wherein said protruding part of said agitating portion includes a plurality of pieces.

* * * * *